US010464273B2

(12) United States Patent
Bertagnolli et al.

(10) Patent No.: US 10,464,273 B2
(45) Date of Patent: Nov. 5, 2019

(54) CELL ASSEMBLIES AND METHODS OF USING THE SAME

(71) Applicant: US SYNTHETIC CORPORATION, Orem, UT (US)

(72) Inventors: Kenneth E. Bertagnolli, Riverton, UT (US); Michael A. Vail, Genola, UT (US); Jiang Qian, Cedar Hills, UT (US); Jason K. Wiggins, Draper, UT (US); Mark P. Chapman, Provo, UT (US); Arnold D. Cooper, Mapleton, UT (US); Debkumar Mukhopadhyay, Sandy, UT (US); Amy Leigh Rodriguez, South Jordan, UT (US); Stephen Rudger Adams, Spanish Fork, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 361 days.

(21) Appl. No.: 15/402,925

(22) Filed: Jan. 10, 2017

(65) Prior Publication Data

US 2017/0210081 A1 Jul. 27, 2017

Related U.S. Application Data

(60) Provisional application No. 62/286,820, filed on Jan. 25, 2016.

(51) Int. Cl.

| | |
|---|---|
| ***B30B 7/04*** | (2006.01) |
| ***B30B 11/00*** | (2006.01) |
| ***B24D 18/00*** | (2006.01) |
| ***B30B 15/34*** | (2006.01) |

(52) U.S. Cl.

CPC ..... *B30B 7/04* (2013.01); *B24D 18/0009* (2013.01); *B30B 11/004* (2013.01); *B30B 15/34* (2013.01)

(58) Field of Classification Search

CPC ..... B30B 7/04; B30B 11/004; B30B 15/34; B24D 18/0009

See application file for complete search history.

(56) References Cited

U.S. PATENT DOCUMENTS

| | | | |
|---|---|---|---|
| 6,338,754 B1 | 1/2002 | Cannon et al. | |
| 8,236,074 B1 | 8/2012 | Bertagnolli et al. | |
| 2004/0134415 A1* | 7/2004 | D'Evelyn ..... | B01J 3/062 117/84 |

(Continued)

OTHER PUBLICATIONS

W. Utsumi et al., "X-Ray Diffraction Under Ultrahigh Pressure Generated With Sintered Diamond Anvils," J. Appl. Phys. 60, 2201 Jun. 1986.

(Continued)

*Primary Examiner* — Nahida Sultana
(74) *Attorney, Agent, or Firm* — Dorsey & Whitney LLP

(57) ABSTRACT

Embodiments disclosed herein relate to cell assemblies for fabricating superhard materials (e.g., used in a high-pressure cubic press) and methods of using the same. The disclosed cell assemblies include a plurality of internal anvils, at least some of which are positioned internally relative to a cell pressure medium of the cell assembly. Such a configuration for the cell assemblies may enable one or more of intensifying cell pressure, reducing processing time, or reducing costs for fabricating such superhard materials.

20 Claims, 18 Drawing Sheets

(56) References Cited

U.S. PATENT DOCUMENTS

| | | | | |
|---|---|---|---|---|
| 2004/0173948 | A1* | 9/2004 | Pandelisev | B29C 43/006 264/500 |
| 2005/0153010 | A1* | 7/2005 | Sung | B01J 3/065 425/330 |
| 2010/0129480 | A1* | 5/2010 | Martin Parrondo | B01J 3/067 425/77 |
| 2013/0266678 | A1* | 10/2013 | Bao | B30B 11/004 425/77 |

OTHER PUBLICATIONS

Mueller, H. J. et al.,"Recent development of experimental techniques for high-pressure mineral physics under simulated mantle conditions," High Pressure Research, 26:4, 529-537, Oct. 2006.

Kunimoto, T. et al., "Pressure generation to 125 GPa using a 6-8-2 type multianvil apparatus with nanopolycrystalline diamond anvils," Journal of Physics: Conference Series 215, (2010) 012190.

Kunimoto, T. et al., "Pressure generation in a 6-8-2 type multi-anvil system: a performance test for third-stage anvils with various diamonds," High Pressure Research, 28:3, 237-244, Sep. 2008.

Kawazoe T. et al., "Pressure generation to 25 GPa using a cubic anvil apparatus with a multi-anvil 6-6 assembly," High Pressure Research, 30:1, 167-174 Mar. 2010.

* cited by examiner

CELL ASSEMBLIES AND METHODS OF USING THE SAME

CROSS-REFERENCE TO RELATED APPLICATION(S)

This application claims priority to U.S. Provisional Application No. 62/286,820 filed on 25 Jan. 2016, the disclosure of which is incorporated herein, in its entirety, by this reference.

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller cone drill bits and fixed cutter drill bits. A PDC cutting element typically includes a superabrasive polycrystalline diamond ("PCD") layer commonly known as a polycrystalline diamond or PCD table. The PCD table is formed and bonded to a substrate using a high-pressure/high-temperature ("HPHT") process. The PDC cutting element may be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a layer of diamond particles adjacent to a surface of a cemented carbide substrate and into a canister assembly. The canister assembly including the cemented carbide substrate and layer of diamond particles therein may be surrounded by various different pressure transmitting media (e.g., salt liners), positioned in a graphite tube having graphite end caps disposed at respective ends of the graphite tube that forms a heater assembly, and finally embedded in a cube-shaped gasket medium (e.g., pyrophyllite). In an HPHT process used to form a PDC, anvils of an ultra-high pressure cubic press apply pressure to the cube-shaped gasket medium and the contents therein, while the cemented carbide substrate and layer of diamond particles are controllably heated to a selected temperature at which sintering of the diamond particles is effected by passing a current through the graphite tube and end caps.

SUMMARY

Embodiments disclosed herein relate to cell assemblies for fabricating superhard materials (e.g., used in a high-pressure cubic press) and methods of using the same. The disclosed cell assemblies include a plurality of internal anvils, at least some of which are positioned internally relative to a cell pressure medium of the cell assembly. Such a configuration for the cell assemblies may enable one or more of intensifying cell pressure, reducing processing time, or reducing costs for fabricating such superhard materials.

In an embodiment, a cell assembly for use in a high-pressure/high-temperature press is disclosed. The cell assembly includes a refractory metal canister assembly having a superabrasive compact precursor assembly disposed at least partially therein. The cell assembly further includes a pressure transmitting medium at least partially surrounding the refractory metal canister assembly. The cell assembly additionally includes a cell pressure medium at least partially surrounding the pressure transmitting medium and the refractory metal canister assembly. The cell assembly further includes a heating element positioned adjacent to the refractory metal canister assembly. The cell assembly also a plurality of anvils. At least some of the plurality of anvils are positioned at least partially within the cell pressure medium.

In an embodiment, a method of HPHT processing a superabrasive compact assembly in a cubic press is disclosed. The method includes providing a cell assembly and disposing a refractory metal canister assembly having the superabrasive compact assembly disposed therein, at least partially within the cell assembly. The cell assembly includes a pressure transmitting medium that at least partially surrounds the refractory metal canister assembly. The cell assembly further includes a cell pressure medium at least partially surrounding the pressure transmitting medium and the refractory metal canister assembly. The cell assembly additionally includes a heating element positioned adjacent to the refractory metal canister assembly. The cell assembly further includes a plurality of anvils. At least some of the plurality of anvils are positioned at least partially within the cell pressure medium. The method further includes subjecting the cell assembly including the refractory metal canister assembly to a high-pressure/high-temperature process.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

FIG. 2CC is a cross-sectional view of a lateral anvil taken along the plane 2CC shown in FIG. 2C.

DETAILED DESCRIPTION

Embodiments disclosed herein relate to cell assemblies for fabricating superhard materials (e.g., used in a high-pressure cubic press) and methods of using the same. The disclosed cell assemblies include a plurality of internal anvils, at least some of which are positioned internally relative to a cell pressure medium of the cell assembly. Such a configuration for the cell assemblies may enable one or more of intensifying cell pressure, reducing processing time, or reducing costs for fabricating such superhard materials.

In one or more embodiments, a cell assembly may include a canister assembly disposed in one or more of a pressure transmitting medium, a heating element adjacent to the pressure transmitting medium, or a cell pressure medium at least partially surrounding the pressure transmitting medium and the canister assembly. At least two internal anvils may be positioned inwardly from a surface of the cell pressure medium, such as partially or entirely within the cell pressure medium. The canister assembly may include a precursor assembly to a superabrasive compact therein, such as a substrate and diamond powder disposed adjacent to the substrate. The cell assembly may be placed in a cubic press for HPHT processing (e.g., application of high pressure and high temperature).

In an embodiment, upon HPHT processing the precursor assembly in the canister assembly, the diamond powder may be sintered together to form a PCD table that bonds to the substrate to form a superabrasive compact such as a PDC. The at least two anvils positioned inwardly from the surface of the cell pressure medium may intensify internal cell pressure experienced by the precursor assembly during HPHT processing. Such a configuration may provide higher internal cell pressure experienced by the canister assembly with relatively lower hydraulic line pressure used in the cubic press (e.g., that pressurizes pistons of the cubic press that applies pressure to the cell assembly). Additional internal anvil configurations may provide for efficient delivery of pressure by the cubic press between the hydraulic lines, anvils, and the canister assembly therein. Such configurations may include anvils of various shapes disposed about at least a portion the canister assembly (e.g., lateral anvils), multiple internal anvils (e.g., multiple lateral anvils and/or axial anvils), and/or anvils having a smaller surface area at the surface(s) proximate to the canister assembly than the surface(s) proximate to the HPHT press anvils.

Figure 1A:
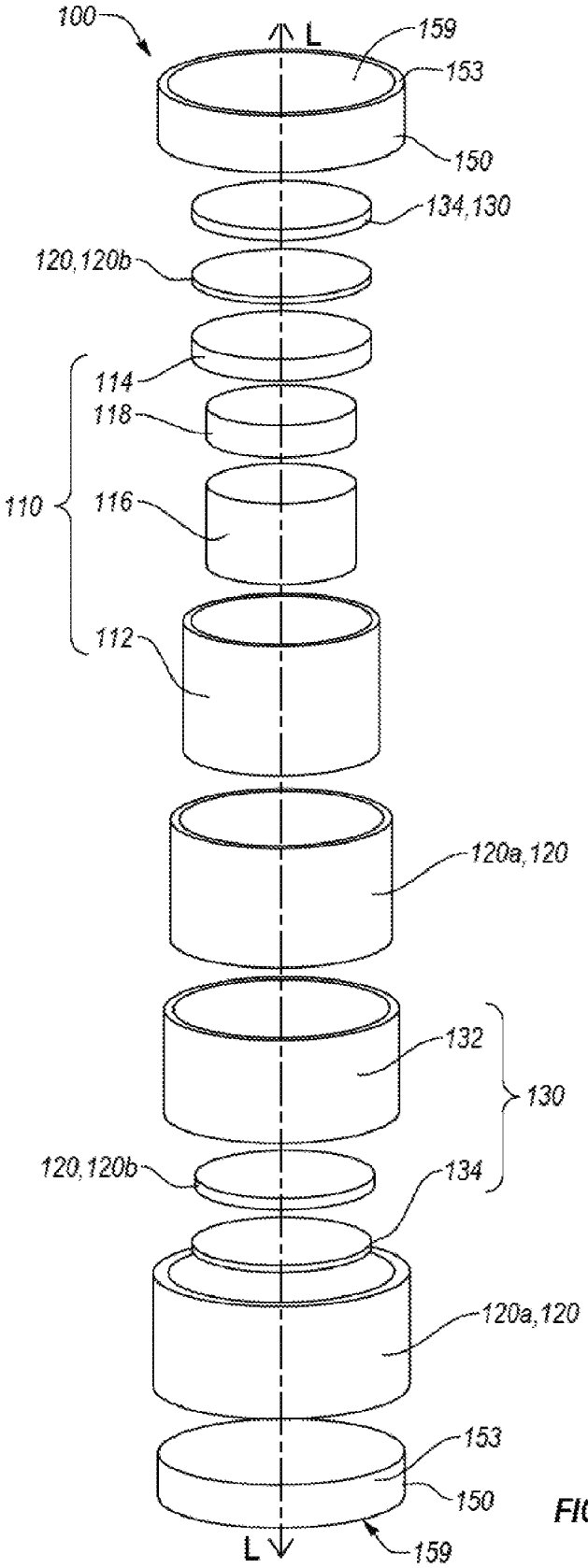
FIG. 1A is an exploded, isometric view of a cell assembly having a canister assembly and internal anvils therein, according to an embodiment.
Figure 1B:
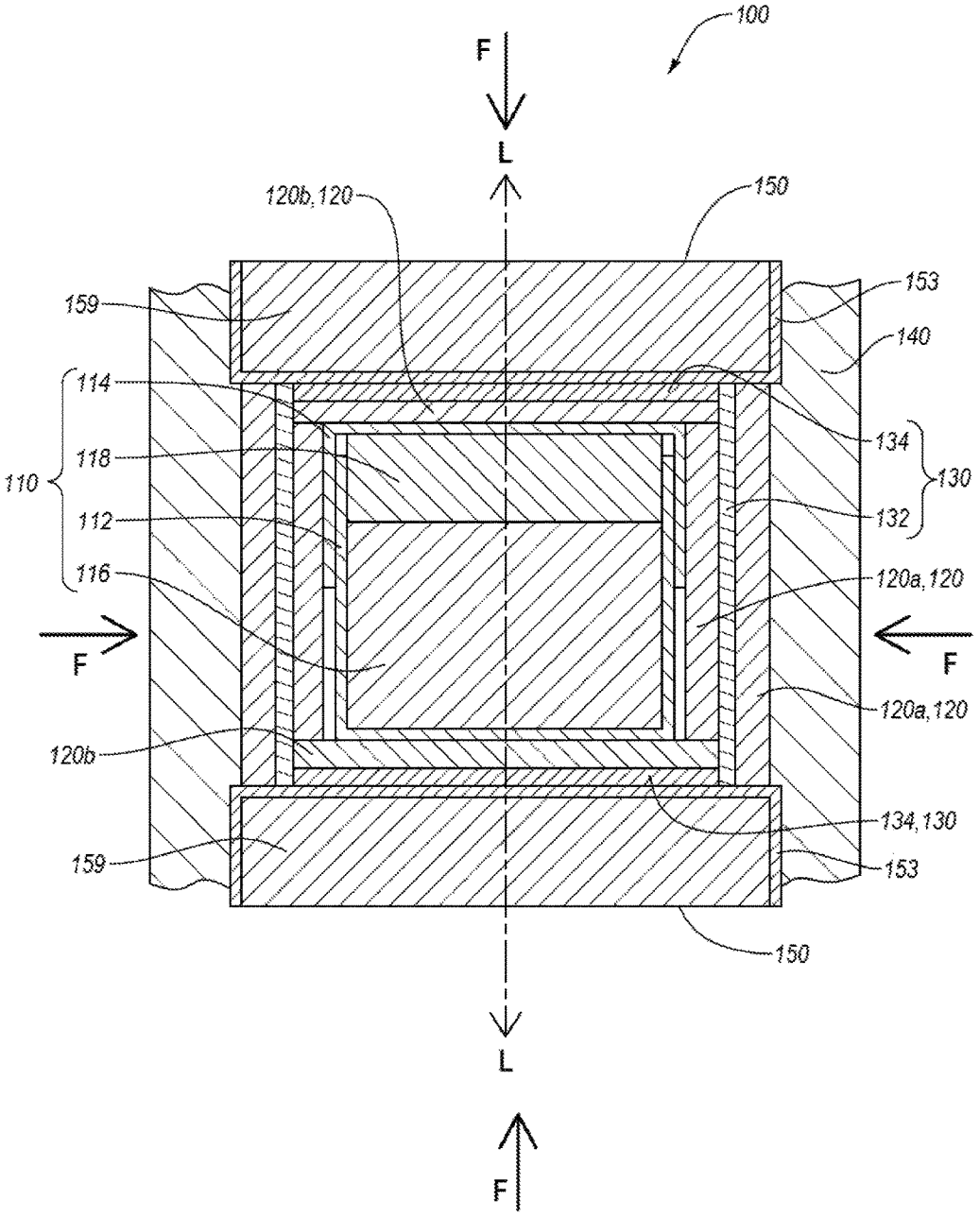
FIG. 1B is an assembled, side cross-sectional view of the cell assembly of FIG. 1A.

FIG. 1A is an exploded, isometric view of a cell assembly 100, according to an embodiment. FIG. 1B is an assembled, side cross-sectional view of the cell assembly 100 shown in FIG. 1A. The cell assembly 100 may include a canister assembly 110. The canister assembly 110 includes a canister 112 having a base portion and one or more peripheral walls extending therefrom and defining a recess therein. The recess terminates at an open end of the canister 112. The canister assembly 110 includes a cap 114 sized and configured to fit over the open end of the canister 112. In an embodiment, the cap 114 may substantially seal the contents of the canister 112 from an external environment via a brazing process, a welding process, or any other suitable process (e.g., a brazing or welding process under at least partial vacuum) that joins the cap 114 to the canister 112. The canister assembly 110 may include a precursor assembly to a superabrasive compact therein, such as a PDC. As discussed in greater detail below, the precursor assembly may include a substrate 116 and a plurality of superabrasive particles 118, such as diamond particles. In some embodiments, the canister assembly 110 includes an upper surface, a lower surface, and at least one lateral surface extending therebetween (e.g., a cylinder having closed substantially planar ends).

The cell assembly 100 may include one or more portions of a pressure transmitting medium 120 having one or more portions 120*a* and 120*b* in FIGS. 1A and 1B. For example, a portion of the pressure transmitting medium 120 may be configured as a cup or tube 120*a*, and another portion of the pressure transmitting medium may be a disc, cap, or plug 120*b* configured to fit on, over, or in the pressure transmitting medium cup or tube 120*a*. As used herein, "pressure transmitting medium 120" may refer to one or both of the pressure transmitting medium cup or tube 120*a*, the pressure transmitting medium disc, cap, or plug 120*b*, as context dictates. The one or more portions of pressure transmitting medium 120 may include one or more adjacent or non-adjacent volumes (e.g., layers) of the pressure transmitting medium 120. Suitable materials for pressure transmitting medium 120 may include salt, graphite, pyrophyllite, a ceramic (e.g., boron nitride, titanium boride, etc.), a refractory metal, or combinations of any of the foregoing. The pressure transmitting medium 120 may be a powder, solid, or pressed powder of any of the foregoing materials. Explaining further, the pressure transmitting medium 120 may be loose powder (e.g., pourable) and/or may be pressed into a green state part (e.g., a coherent mass of salt particles). In an embodiment, the particles in the green state part may be substantially compressed to form a coherent unitary part having a definite shape, but the particles are not permanently bonded together. The one or more portions of the pressure transmitting medium 120 may include a first portion proximate to the canister assembly 110, such as in direct contact with the canister 112 and/or cap 114. The pressure transmitting medium 120 may have a recess or cavity formed therein, the cavity being sized and configured to at least receive, hold, enclose, or at least partially surround the canister assembly 110 therein.

The cell assembly 100 may include a heating element 130. The heating element 130 may be configured as an electrically resistive heating element, such as comprising graphite, silicon carbide, tungsten, other suitable electrically resistive materials, or combinations of any of the foregoing. One or more portions of the heating element 130 may be positioned over at least a portion of (e.g., partially or completely enclosing) the one or more portions of the pressure transmitting medium 120 proximate to the canister assembly 110. The heating element 130 may have one or more walls defining a recess or cavity therein. For example, the heating element 130 may include a generally cylindrical tube 132. In some embodiments, the heating element 130 may include one or more end heaters 134 (e.g., circular disks or plugs disposed adjacent to an end of the canister assembly 110). In some embodiments, the heating element 130 may include the cylindrical heater tube 132 and one or more end heaters 134 that may collectively define a cylinder having a cavity therein. The cavity may be sized and configured to receive, hold, enclose, or at least partially surround the canister assembly 110 and/or the pressure transmitting medium 120 therein. In such embodiments, the heating element 130 may include one or more cylindrical tubes 132 (e.g., at least one lateral surface) extending around the canister assembly 110 and/or one or more end heaters 134 (e.g., lower and/or upper surfaces). The heating element 130 may be heated by alternating or direct current that passes through the heating element 130. In some embodiments, the cell assembly 100 may also include one or more electrical contacts configured to provide an electrical connection between a power source and the heating element 130. In some embodiments, the electrical contacts may include a portion of the anvils (e.g., a conductive material thereon), one or more conductive structures (e.g., wires, disks, tubes, etc.), or any other conductive elements suitable to conduct electricity the heating element 130, effective to cause inductive heating therein. In an embodiment, the one or more portions of the pressure transmitting medium 120 may include a second portion(s) distal to the canister assembly 110. The second portion(s) may be disposed adjacent to the canister assembly 110 and may be a layer of the pressure transmitting medium 120 (e.g., a ceramic insulator) positioned between at least a portion of the heating element 130 and one or more anvils and/or cell pressure medium ("CPM") 140 therearound.

As briefly discussed above, the cell assembly 100 may include the CPM 140 enclosing at least a portion of the canister assembly 110, the one or more portions of pressure transmitting medium 120, and the heating element 130. For example, the CPM 140 may completely or partially encapsulate or surround one or more of the canister assembly 110, the one or more portions of the pressure transmitting medium 120, or the heating element 130 therein. In an embodiment, the CPM 140 may be cold pressed around the canister assembly 110, the one or more portions of the pressure transmitting medium 120, and the heating element 130. In another embodiment, the CPM 140 may be cold pressed and a through hole or other cavity may be formed in the cold pressed CPM 140. Suitable materials for the CPM 140 include pyrophyllite, osmium, oxides (e.g., metal oxides such as $Al_2O_3$, $CaO_2$, $Fe_3O_4$, MgO, or $SiO_2$), garnet, salts (e.g., AgCl, NaCl, KCl, etc.), one or more carbides (e.g., WC, SiC, or $Al_4C_3$), talc, or combinations of any of the foregoing. An example of suitable material for the CPM 140 is disclosed in U.S. Pat. No. 6,338,754, the disclosure of which is incorporated herein, in its entirety, by this reference. In some embodiments, the CPM 140 may include one or more materials (e.g., non-refractory metals) having a coefficient of thermal expansion ("CTE") and/or bulk modulus effective to provide a selected amount of expansion of the CPM 140 under HPHT conditions. The CPM 140 may be a powder of one or more of any of the foregoing materials. The powder may be loose (e.g., pourable) and/or may be pressed into a green state part. The particles in the green state part may be substantially compressed (e.g., cold pressed) to form a coherent unitary part having a definite shape, but which are not permanently bonded together. Upon application of high pressure and/or high temperatures, the CPM 140 may deform, flow, extrude, compress, or otherwise move (e.g., to areas of lower pressure), thereby forming a gasket between one or more portions of the cell assembly 100 and the anvils of the cubic press. As the CPM 140 is compressed by the cubic press anvils and/or internal anvils 150, the CPM 140 may form a gasket between one or more portions of the cell assembly 100 and the anvils of the cubic press and/or between adjacent internal anvils. The gasket of CPM 140 may allow, support, or increase the pressure transfer from the cubic press to the canister assembly 110 in the cell assembly 100.

In some embodiments, the cell assembly 100 includes a plurality of internal anvils 150 positioned internal to the CPM 140, such as at least partially within the CPM 140 or completely enclosed within (e.g., entirely within the outer surface(s) of the volume of) the CPM 140. Each of the pressure transmitting medium 120, heating element 130, internal anvils 150, CPM 140, or any other portions of the cell assembly 100 may be axially aligned (e.g., substantially centered) with a longitudinal axis L of the cell assembly 100. The one or more internal anvils 150 (e.g., axial anvils) may be disposed proximate to the end (e.g., top and/or bottom) surfaces of the canister assembly 110, such as external to the heating element 130 and the pressure transmitting medium 120. Upon application of forces F on the cell assembly 100, the compression, in combination with high temperatures (e.g., provided by the heating element 130) may cause the precursor materials in the canister assembly 110 to bond together to form a sintered superabrasive compact such as a PDC. The internal anvils 150 may provide less compressible material between the canister assembly and the external anvils of the cubic press (not shown); which may provide relatively higher generated (e.g., intensified) pressure from the cubic press (e.g., more pressure delivered to the canister assembly per unit of pressure applied in hydraulic lines of the cubic press). In some embodiments, the internal anvils 150 may include one or more materials (e.g., non-refractory metals) therein having a CTE and/or bulk modulus with a dominant effect at HPHT conditions. In such embodiments, the CTE and/or bulk modulus of the anvil material may be effective to increase the overall pressure in the cell assembly due to expansion of material in the internal anvils under HPHT conditions. Such materials may exhibit a bulk modulus above about 150 GPa, such as above about 200 GPa, above about 300 GPa, or above about 400 GPa.

In some embodiments the internal anvils 150 may include an electrically conductive (e.g., metallic) container 153. For example, the conductive container 153 may form a cup or ring having anvil material(s) 159 therein. The conductive container 153 may include one or more metals or alloys, such as iron, steel (e.g., stainless steel, A-2 tool steel), titanium, tungsten, zirconium, one or more refractory metals (e.g., niobium), one or more high CTE materials, any other metal, or alloys of any of the foregoing. In an embodiment, each of the internal anvils 150 may be configured as a metal container defined by the conductive container 153 having an inner surface and at least one lateral surface. The inner surface and at least one lateral surface collectively define a recess into which one or more anvil materials 159 may be placed. The anvil materials 159 may include any of the above metals, a ceramic (e.g., cemented tungsten carbide), a cermet, boron nitride, polycrystalline diamond, any other material having a hardness suitable for use as a HPHT press head, a piezoelectric material configured to provide a current under elevated pressure, pressure sensitive materials configured to expand to new transitional structures under high pressures (e.g., chromium carbide), a small amount of an explosive material (e.g., glycine-nitrate), any material that flows and/or deforms less than the CPM material associated therewith, or combinations of one or more of the foregoing. The piezoelectric material may provide a current to the cell assembly (e.g., heating material) under elevated pressure (e.g., pressure above atmospheric). The pressure sensitive material may transition to a different crystal structure or prevent large grain growth in the matrix of the anvil material (s) under elevated pressure. The explosive material may provide additional pressure in the cell assembly due to rapid expansion of gases during explosion thereof at high temperatures.

In some embodiments, the conductive container 153 may completely enclose the anvil material 159 (not shown). The conductive container 153 may conduct electrical current from the HPHT press through the one or more internal anvils 150 to the heating element 130 (e.g., one or more of the cylindrical heater tube 132 or end heaters 134). In some embodiments, the conductive container 153 may be used on at least two internal anvils, effective to conduct current across and through the heating element 130. In some embodiments, the conductive container 153 may contact the end heater 134 along the entire surface of the end heater 134. In some embodiments, the conductive container 153 may be disposed about only a portion of the face and/or peripheral surface of the internal anvil 150 (e.g., a ring-shaped gasket between the internal anvil and the heating element 130 or an annular band about the peripheral surface of the internal anvil 150) such that only a portion of the conductive container 153 contacts a portion of the heating element 130 effective to conduct electricity therebetween. In some embodiments, the anvil material 159 may include one or more layers of any of the above materials, such as a first layer of a ceramic and a second layer of a refractory metal. In an embodiment, an internal anvil 150 may include an alumina layer and a cemented tungsten carbide layer at least partially enclosed in a conductive container 153. In an embodiment, an internal anvil 150 may include a cemented tungsten carbide layer and a CPM layer at least partially enclosed in a conductive container 153.

In some embodiments, the internal anvils 150 may include substantially homogeneous construction, such as a button or disk of a single material (e.g., without a conductive container 153). In some embodiments and as discussed in more detail below, the internal anvils 150 may include anvils of different configurations than those depicted in FIGS. 1A-1B, such as anvils having a greater surface area on an outer surface adjacent to the external anvils of the HPHT press than at an inner surface of the anvils adjacent to the canister assembly 110. Such a configuration may provide an intensification of the pressure developed within the cell assembly 100 by transferring the force applied at the outer surface to a smaller inner surface.

The one or more internal anvils 150 may be constructed of at least one of one or more non-refractory metals (e.g., a steel, titanium, zirconium, vanadium, etc.), one or more refractory metals (tungsten, niobium, etc.), one or more ceramics (e.g., carbides such as tungsten carbide, vanadium carbide, etc.), one or more cermets (e.g., cemented carbides such as cobalt-cemented tungsten carbide), diamond (e.g., diamond or sintered polycrystalline diamond), or any other material suitable to withstand pressures of at least about 4 GPa.

As noted above, in some embodiments, the canister assembly 110 may hold the contents for producing a PDC. In such embodiments, the canister assembly 110 may include the precursor materials to a superabrasive compact (e.g., a precursor assembly). Such precursor assemblies may include a substrate 116, a plurality of superabrasive particles 118, and optionally, a catalyst material. The superabrasive particles 118 may include a plurality of diamond particles, cubic boron nitride particles, carbide (e.g., tungsten carbide) particles, or combinations of the foregoing. The plurality of superabrasive particles 118 may include a volume of loose particles (e.g., a boron nitride or diamond powder) or a sintered mass of bonded superabrasive grains (e.g., a plurality of bonded diamond grains).

The plurality of superabrasive particles may exhibit one or more average particle sizes. For example, the superabrasive particles may exhibit a single mode (e.g., single average grain size), a bimodal distribution (e.g., a volume of diamond grains comprising two average grain sizes), or any other multimodal distribution (e.g., trimodal, quadmodal, etc.). In an embodiment, a bimodal distribution of superabrasive particles may include a first mode having a first, smaller average particle size, and the superabrasive particles may include a second mode having a second, larger average particle size. The plurality of superabrasive particles may exhibit one or more selected sizes. The one or more selected sizes may be determined, for example, by passing the diamond particles through one or more sizing sieves or by any other method. In an embodiment, the plurality of superabrasive particles may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). In various embodiments, the plurality of superabrasive particles may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In an embodiment, the plurality of superabrasive particles may include a portion exhibiting a relatively larger size between about 40 μm and about 15 μm and another portion exhibiting a relatively smaller size between about 12 μm and 2 μm. Of course, the plurality of superabrasive particles may also include three or more different sizes (e.g., one relatively larger size and two or more relatively smaller sizes), without limitation.

In some embodiments, the plurality of superabrasive particles may exhibit a single particle size, a bimodal particle size distribution, or a trimodal or greater particle size distribution. In some embodiments, the precursor assembly may include a pre-formed superabrasive body (e.g., PCD disk) in place of or in addition to the superabrasive particles 118. In some embodiments, the pre-formed superabrasive body may be at least partially leached. The pre-formed superabrasive body may be bonded to a substrate in the cell assembly 110 via HPHT processing.

In some embodiments, the substrate 116 of the precursor assembly may include one or more carbides, such as tungsten carbide, titanium carbide, chromium carbide, niobium carbide, tantalum carbide, vanadium carbide, or combinations thereof. The one or more carbides of the substrate 116 may be cemented with iron, nickel, cobalt, or alloys thereof. For example, in an embodiment, the substrate 116 includes cobalt-cemented tungsten carbide. The precursor assembly may include a catalyst material therein. The catalyst material is chosen to catalyze formation of bonds between superabrasive particles during HPHT sintering to form sintered superabrasive grains. Such catalyst materials may include a metal-solvent catalyst (e.g., nickel, iron, cobalt), a carbonate catalyst, hydroxides, polyaromatic hydrocarbons, or any other catalyst suitable for catalyzing superabrasive particle to particle (e.g., diamond-to-diamond) bond formation. The catalyst may be admixed into the superabrasive particles prior to sintering; positioned adjacent to the superabrasive particles such as in a layer, coating, foil, or disc; and/or may be present in the substrate, such as the cementing constituent in a cemented tungsten carbide substrate. The precursor assembly may be positioned within the canister 112 to form a portion of the canister assembly 110.

As described above, the canister assembly 110 includes the canister 112 defining a recess with an open end. In some embodiments, the canister 112 may be generally cylindrical. As shown, the substrate 116 and the plurality of superabrasive particles 118 may be disposed within the recess in the canister 112. The substrate 116 may be disposed adjacent to the closed end of the canister 112 as shown, with the superabrasive particles 118 adjacent to the substrate 116. In other embodiments, the superabrasive particles 118 may be disposed adjacent to the closed end of the canister 112 with the substrate 116 disposed adjacent to the superabrasive particles 118. The cap 114 of the canister assembly 110 is sized and configured to fit over the canister 112 and substantially seal the open end and the contents of the canister 112 from the external environment. For example, one or more lateral surfaces of the cap 114 may overlap the one or more lateral surfaces of the canister 112, which may be adhered, brazed, crimped, press-fit, soldered, welded, or otherwise sealed together. Examples of suitable canister assemblies and techniques for sealing such canister assemblies are disclosed in U.S. Pat. No. 8,236,074, the disclosure of which is incorporated herein, in its entirety, by this reference.

In some embodiments, a cell assembly may include two or more canister assemblies. The two or more canister assemblies may be longitudinally stacked in a single pressure transmitting medium cup or tube 120*a* or each in respective pressure transmitting medium cup or tube 120*a*. In some embodiments, one or more pressure transmitting medium discs 120*b* may be disposed between each canister assembly. In an embodiment, a first canister assembly may be positioned at least partially within a pressure transmitting medium tube 120*a* and a second canister assembly may be positioned in a second pressure transmitting medium tube 120*a*. Each canister assembly may have a respective pair of pressure transmitting medium discs 120*b* disposed thereof at each longitudinal end of the pressure transmitting medium tube 120*a*. The canister assemblies including the pressure transmitting mediums 120 associated therewith may be longitudinally stacked head to head (e.g., substrates facing substrates or diamond powder facing diamond powder of the adjacent canister assemblies) or head to toe (e.g., substrate facing diamond powder of the adjacent canister assembly). In some embodiments, the stacked canister assemblies having an electrically conductive path therebetween may be disposed in a single heating element 130 or each in individual heating elements 130 having a conductive path therebetween. In some embodiments, one or more end heaters 134 may be disposed between each of the longitudinally stacked canister assemblies. Such multiple canister embodiments may enable for formation of multiple PDCs in one press cycle. Such multiple canister assembly configurations may be used in any of the embodiments disclosed herein.

Figure 1C:
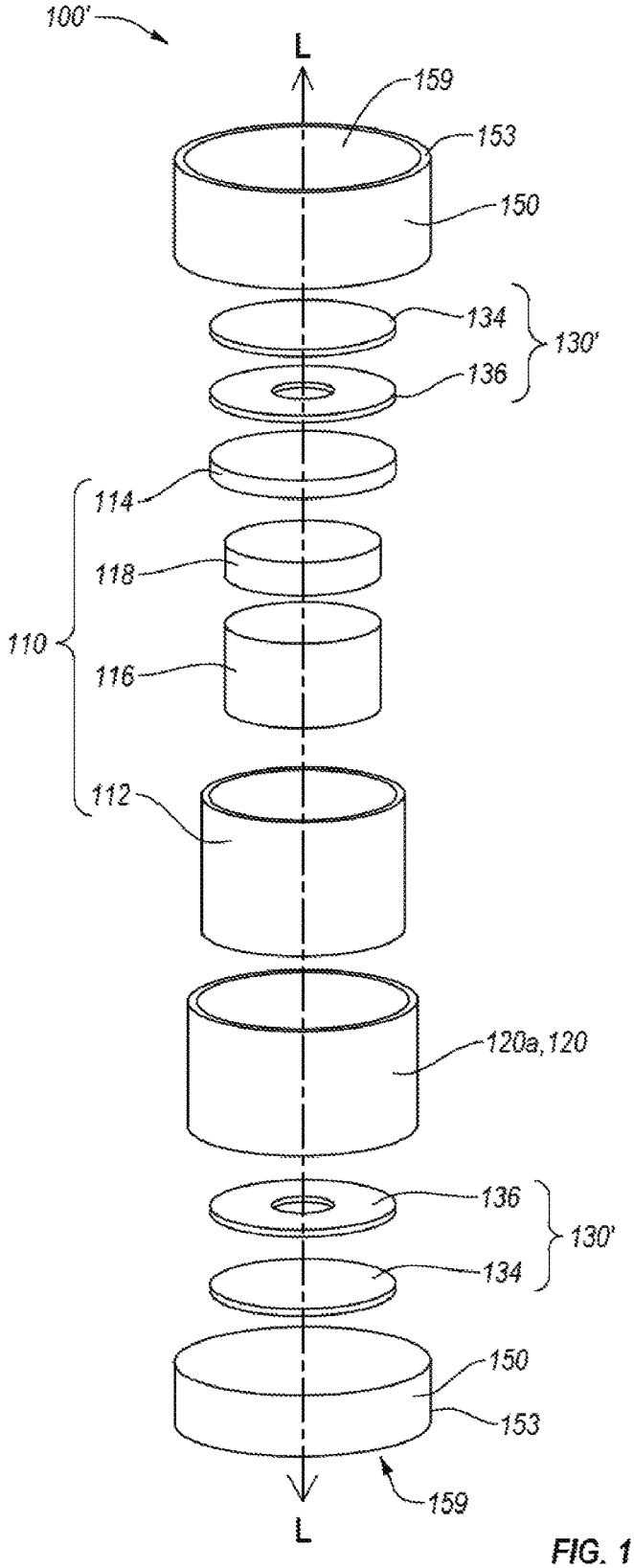
FIG. 1C is an exploded, isometric view of a cell assembly having a canister assembly and internal anvils therein, according to an embodiment.
Figure 1D:
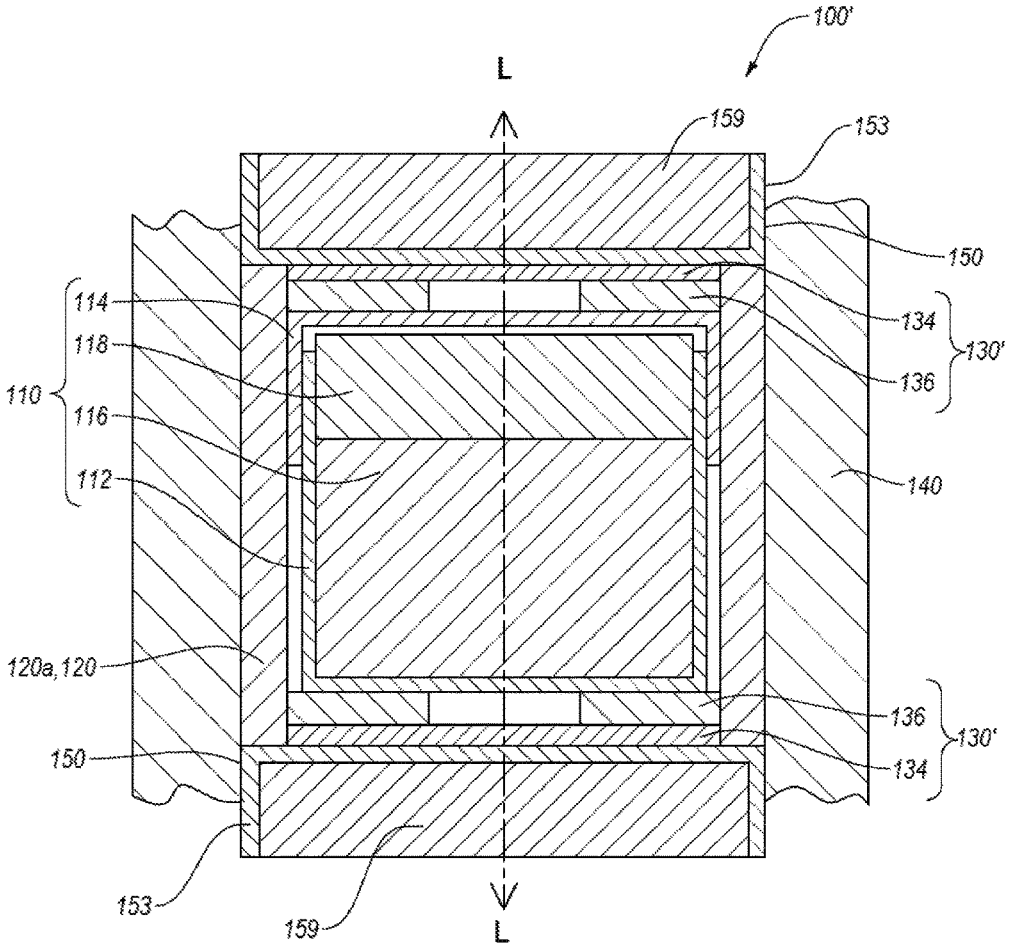
FIG. 1D is an assembled, side cross-sectional view of the cell assembly of FIG. 1C.

Various cell assembly configurations may be used, such as cell assemblies having different heating configurations, internal anvil configurations, and/or canister assembly configurations than shown above. FIG. 1C is an exploded, isometric view of a cell assembly 100'. FIG. 1D is an assembled, side cross-sectional view of the cell assembly 100'. The cell assembly 100' includes the canister assembly 110, the pressure transmitting medium 120 (e.g., pressure transmitting medium tube 120*a*), the cell pressure medium 140, and the internal anvils 150 described above. The cell assembly 100' includes a different configuration for a heating element 130' than the cell assembly 100. For example, as shown in FIGS. 1C and 1D, the heating element 130' includes one or more end heaters 134 (substantially as described above) and gasket elements 136. The gasket elements 136 may include insulating materials (e.g., electrically insulating) such as a salt, mica, a carbide, another type of ceramic insulator, combinations thereof, etc. In some embodiments, the gasket elements 136 may be substantially planar. In some embodiments, the gasket elements 136 may be substantially annular, having at least one hole therethrough, in at least a portion thereof (e.g., in the center of the gasket element 136). The gasket elements 136 may be configured as disks of insulating (or in some embodiments, electrically conductive material) located between the internal anvils 150 and the cell assembly 110, such as between the canister assembly 110 and the end heaters 134 (FIGS. 1C and 1D), and/or between the internal anvils 150 and the end heaters 134 and/or heater tube 132. The gasket elements 136 may be shaped, configured, and positioned to provide electrical insulation and/or electrical conduction between the internal anvils 150, the canister assembly 110, and the heater tube 132 and/or end heaters 134. In some embodiments, the gasket elements 136 may provide electrical insulation between the HPHT press anvils and the canister assembly until a conductive material is compressed through one or more holes therein. In some embodiments, the end heater 134 may be configured to deform through the one or more holes in the gasket element 136 upon compression of the cell assembly 100' in an HPHT press. When the gasket element 136 is formed of an insulating material, such deformation of the end heater 134 and contact with the canister assembly 110 may provide an electrical current path between the anvils of the HPHT press (not shown), the internal anvils 150, the end heater 134, and the canister assembly 110 (e.g., cap 114 and/or cup 112).

In some embodiments, one or more of the internal anvils 150 may be operably coupled to an electrical power source, such as when the internal anvils 150 are disposed entirely within the cell pressure medium 140. The internal anvil(s) 150 may by operably coupled to an electrical power source by a wire, cable, or other conductive member. In some embodiments, the internal anvils 150 may be operably coupled to an electrical power source via the HPHT press anvils in direct contact therebetween. In some embodiments, the gasket elements 136 may include any of the heater materials or internal anvil materials capable of conducting electricity disclosed herein. In some embodiments, the gasket elements 136 may be used in combination with the heater tube 132 as described with respect to FIGS. 1A and 1B. In an embodiment, a stack of canister assemblies may include a gasket element 136 and end heater 134 at a first and second longitudinal end thereof and one or more end heaters between each of the individual canister assemblies therein. In such embodiments, a current may be passed between each of the canister assemblies in the stack to provide high temperature treatment during a press cycle.

Figure 2A:
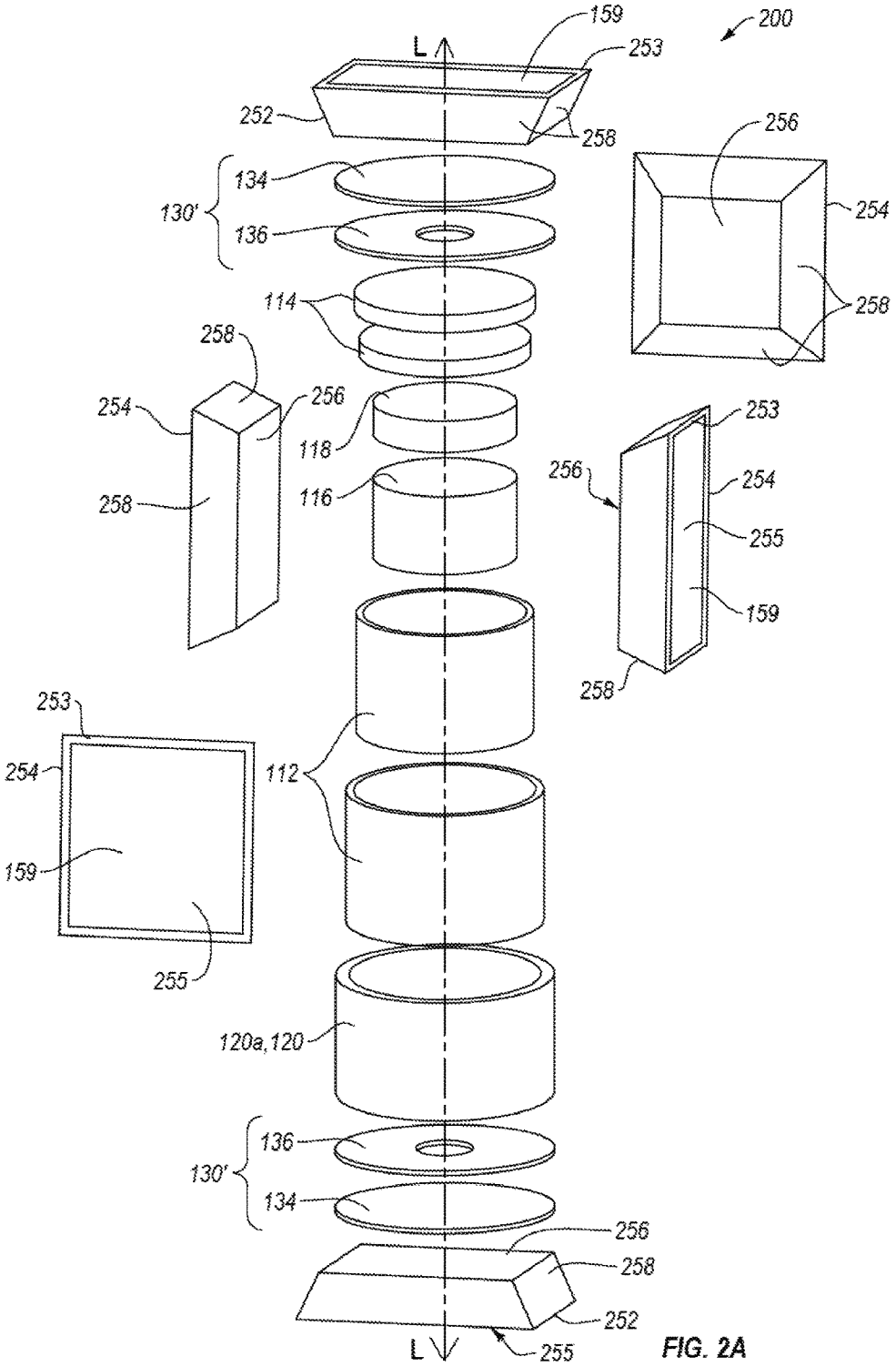
FIG. 2A is an exploded, isometric view of a cell assembly having a canister assembly and internal lateral anvils therein, according to an embodiment.
Figure 2B:
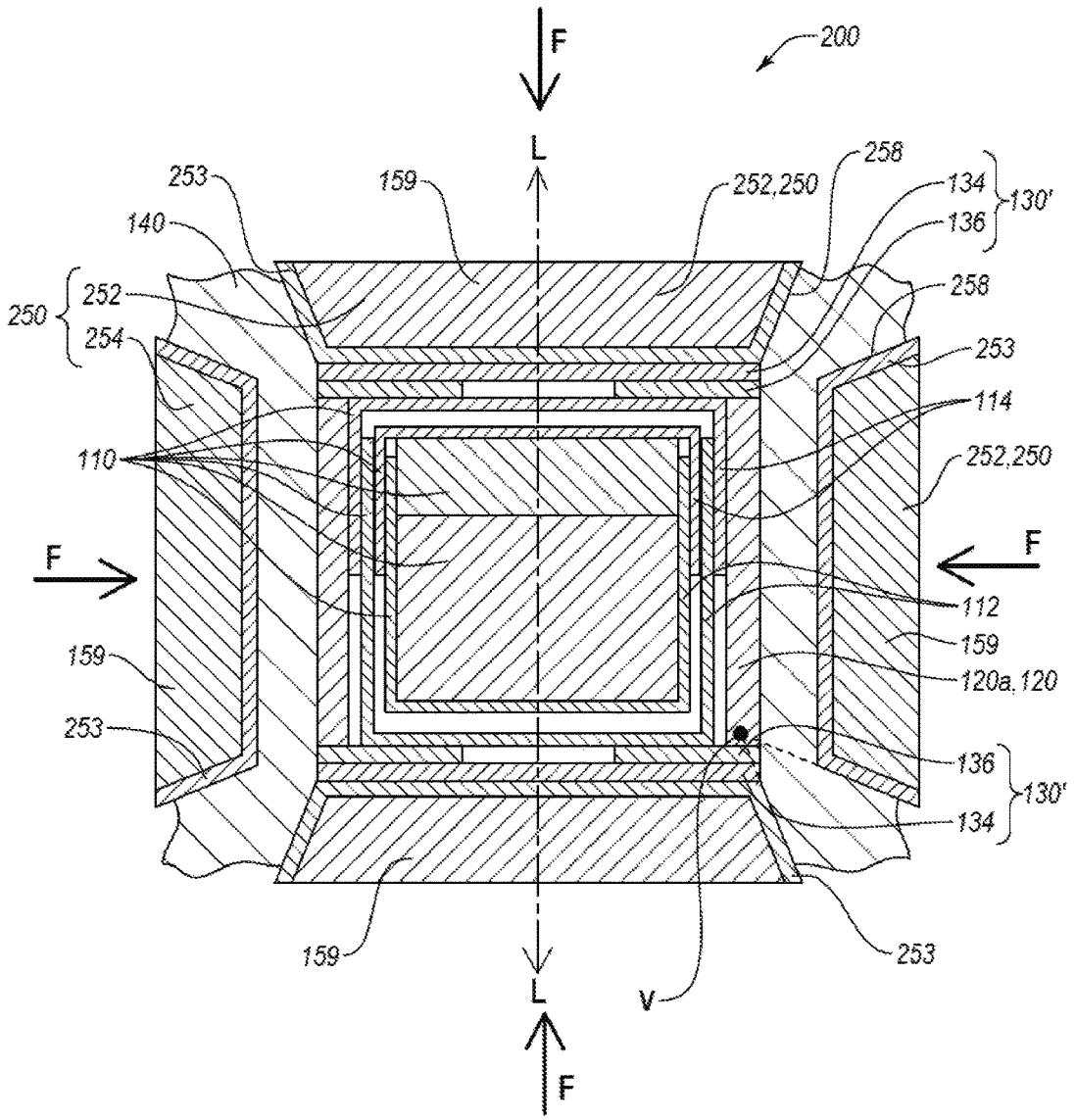
FIG. 2B is an assembled, side cross-sectional view of the cell assembly of FIG. 2A.
Figure 2C:
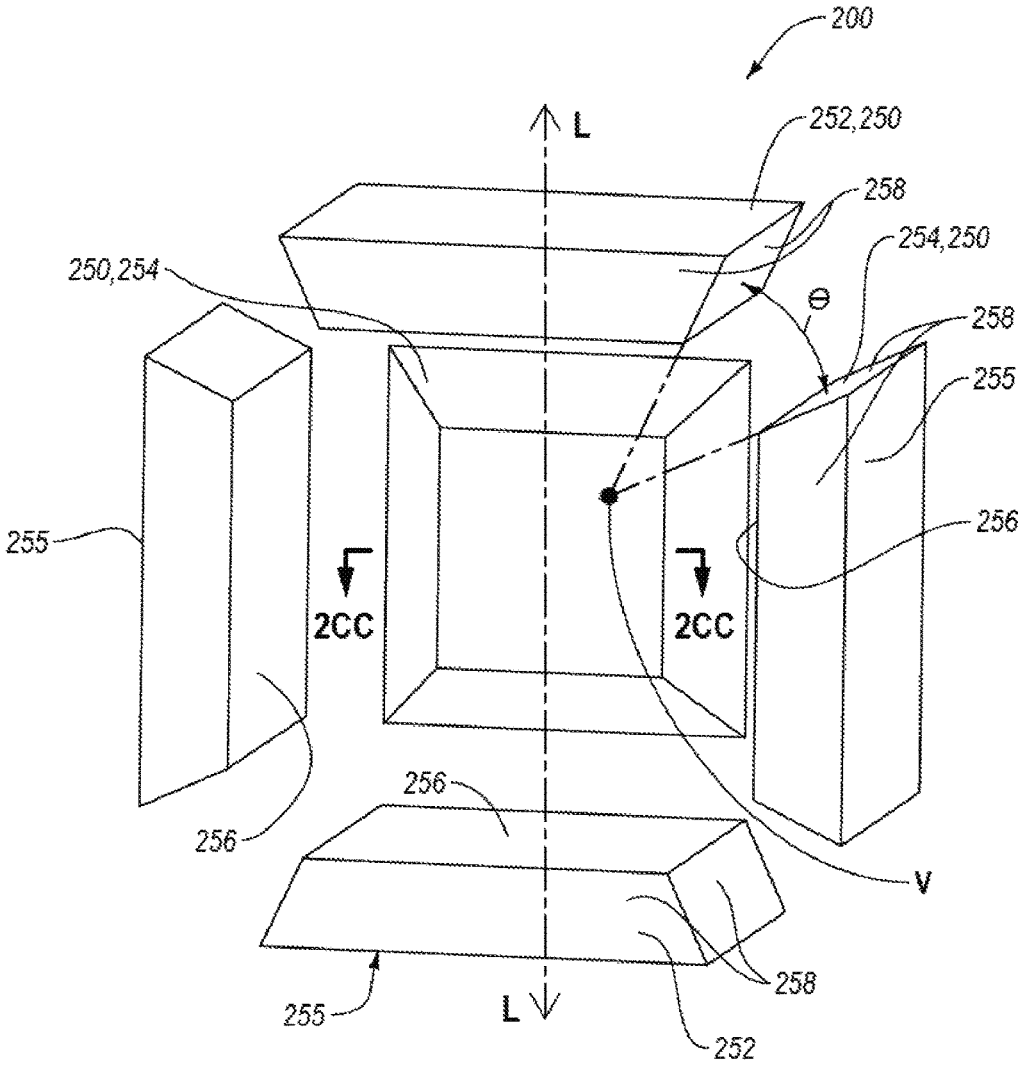
FIG. 2C is an isometric view of t some of the internal anvils shown in FIGS. 2A and 2B.
Figure 2C:
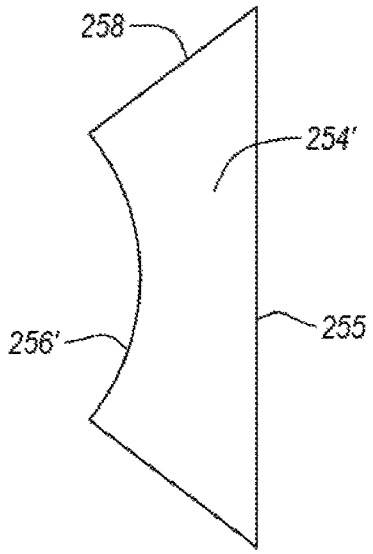

In some embodiments, a cell assembly may include a plurality of internal anvils within the CPM, such as a plurality of lateral anvils extending circumferentially about a canister assembly, in addition to one or more internal anvils positioned axially with respect to the canister assembly. FIG. 2A is an exploded, isometric view a cell assembly 200, according to an embodiment. FIG. 2B is an assembled, side cross-sectional view of the cell assembly 200. FIG. 2C is an isometric view of some of the internal anvils 250 shown in FIGS. 2A and 2B. The cell assembly 200 may include the canister assembly 110 therein.

As illustrated, in some embodiments, the canister assembly 110 may include more than one cap 114 and canister 112. The cell assembly 200 includes one or more portions of the pressure transmitting medium 120 (such as pressure transmitting medium tube 120*a* or disk 120*b* (not shown), the heating element 130' (e.g., end heaters 134 and gasket elements 136), and the CPM 140, oriented about a longitudinal axis L of the cell assembly 200. The cell assembly 200 includes a plurality of internal anvils 250. The internal anvils 250 may be positioned at least partially internal to the CPM 140. The plurality of internal anvils 250 may include one or more axial anvils 252 and one or more lateral anvils 254. The one or more axial anvils 252 may be configured similarly or identical to the internal anvils 150 described above. With respect to the longitudinal axis L defined by the canister assembly 110, the one or more axial anvils 252 may be positioned adjacent to the cap 114 and/or the canister 112 of the canister assembly 110 and be generally centered about the longitudinal axis L. The plurality of lateral anvils 254 may be positioned about the lateral surface (e.g., circumference) of the canister assembly 110. In an embodiment, each of the plurality of lateral anvils 254 may be positioned substantially equidistantly from an adjacent one of the plurality of lateral anvils 254. Suitable anvil configurations for the internal anvils 250 are disclosed in W. Utsumi et al., X-Ray Diffraction Under Ultrahigh Pressure Generated With Sintered Diamond Anvils, J. Appl. Phys. 60, 2201 (1986), the disclosure of which is incorporated herein, in its entirety, by this reference. In an embodiment, the plurality of lateral anvils 254 includes four or more lateral anvils 254. In an embodiment, each of four lateral anvils 254 may be circumferentially spaced at substantially equal intervals (e.g., at each 90 degree location of a unit circle) about the longitudinal axis L (e.g., generally centered in a center of the canister assembly 110). In such embodiments, application of forces F on the cell assembly 100 (from a plurality of anvils in a cubic press) inwardly from four lateral directions and two axial directions (e.g., with respect to the longitudinal axis L, current path through the axial anvils 252, the end heaters 134, or the gasket elements 136, or vertically) may compress the CPM 140 into a gasket between adjacent surfaces (e.g., adjacent external surfaces of adjacent internal anvils 250 and/or between the internal anvils 250 and the canister assembly 110) and force the plurality internal of anvils 250 toward the canister assembly 110 from axially above, below, and laterally inward about the lateral surfaces of the canister assembly 110. The internal anvils 250 positioned at least partially within the CPM 140 may provide less compressible material between the canister assembly 110 and the external anvils of the cubic press (not shown), which may allow for relatively higher pressure to develop within the cell assembly 200 (e.g., more pressure generated per unit of pressure applied in hydraulic lines of the cubic press) than is developed in the CPM of a cell assembly without internal anvils. As the CPM 140 is compressed by the cubic press anvils (not shown) and/or the internal anvils 250, the CPM 140 may form a gasket between one or more portions of the cell assembly 200 and the anvils of the cubic press and/or between adjacent internal anvils 250. The gasket of CPM 140 may lock the components of the cell assembly in position, which may support, allow, and/or increase the pressure transfer from the cubic press to the canister assembly 110 in the cell assembly 200.

As discussed in more detail below with respect to FIG. 2E, the internal anvils 250 (axial anvils 252 and/or lateral anvils 254) may be similar or identical to the internal anvils 150 disclosed above. For example, the internal anvils 250 may include an electrically conductive, metal container 253 having one or more anvil materials 159 therein. The metal container 253 may be similar or identical to the electrically conductive container 153 described above. The anvil material 159 may be similar or identical to any of those anvil materials described above.

In some embodiments, the internal anvils 250 may exhibit a thickness of about 500 μm or more, such as about 500 μm to about 10 cm, about 750 μm to about 1.25 cm, about 1 cm to about 1.5 cm, about 1.5 cm to about 2 cm, about 2 cm to about 3 cm, about 3 cm to about 5 cm, about 5 cm to about 10 cm, less than about 10 cm, or less than about 5 cm. In some embodiments, the axial anvils 252 and the lateral anvils 254 may exhibit the same thickness (as measured from inner surface 256 to pressure outer surface 255). In some embodiments, the axial anvils 252 may be thicker than the one or more lateral anvils 254, such as 20% thicker or more. In some embodiments, the axial anvils 252 may be about 20% to about 100% thicker than the lateral anvils 254, about 30% to about 60% thicker than the lateral anvils 254, about 60% to about 100% thicker than the lateral anvils 254, about 20% to about 100% thicker than the lateral anvils 254, about 25% to about 50% thicker than the lateral anvils 254, about 50% to about 75% thicker than the lateral anvils 254, or about 75% to about 100% thicker than the lateral anvils 254. In some embodiments, the axial anvils 252 may be about 20% to about 100% thinner than the lateral anvils 254, about 30% to about 60% thinner than the lateral anvils 254, about 60% to about 100% thinner than the lateral anvils 254, about 20% to about 100% thinner than the lateral anvils 254, about 25% to about 50% thinner than the lateral anvils 254, about 50% to about 75% thinner than the lateral anvils 254, or about 75% to about 100% thinner than the lateral anvils 254. In some embodiments, the lateral anvils 254 may exhibit a height of about 100% of the height of the canister assembly 110 or less, such as about 50% to about 100%, about 60% to about 90%, about 70% to about 80%, about 5% to about 95%, or about 85% to about 99% of the height of the canister assembly 110. The height of the lateral anvils 254 may be defined by the height of the inner surface 256 and/or the outer surface 255, as measured from a lateral surface to an opposite lateral surface at the inner surface 256 and/or outer surface 255 of a respective one of the lateral anvils 254.

In some embodiments, the internal anvils 250 may include anvils of different configurations such as those depicted having a greater surface area on the outer surface 255 adjacent to the external anvils of the cubic press than the inner surface 256 adjacent to the canister assembly 110. Such a configuration may provide an intensification of the force delivered to the outer surface 255 by transferring the force received at the outer surface 255 to a smaller surface area at the inner surface 256. Accordingly, the axial anvils 252 and/or lateral anvils 254 may include a configuration that tapers otherwise changes (e.g., steps), or increases from a smaller surface area at the inner surface 256 to a larger surface area at the outer surface 255. The inner surfaces 256 and outer surfaces 255 may be different shapes, similar shapes, or congruent shapes. The internal anvils 250 include at least one lateral surface 258 extending between the inner surface 256 and the outer surface 255. Such tapered or otherwise changing surface area configurations may exhibit a ratio of surface area at the inner surface 256 to surface area at the outer surface 255 of 0.1 or more, such as about 0.1 to about 0.95, about 0.01 to about 0.3, about 0.3 to about 0.6, about 0.6 to about 0.9, about 0.2 to about 0.5, about 0.5 to about 0.9, about 0.6 to about 0.8, about 0.7 to about 0.95, about 0.8 to about 0.9, or less than about 0.99.

Although depicted with heating element 130', the cell assembly 200 may alternatively or additionally include a heating element 130 as described herein.

FIG. 2C illustrates the configuration of the internal anvils 250 in FIGS. 2A and 2B with one lateral anvil 254 removed for clarity. As shown in FIGS. 2A and 2C, the internal anvils 250 may be positioned in a substantially cubic configuration (depicted with only five internal anvils in FIG. 2C), with each of the plurality of lateral anvils 254 being disposed circumferentially about a longitudinal axis L (or, when present, about the lateral surface of a canister assembly) and each of the axial anvils 252 positioned on (e.g., axially along) the longitudinal axis L. The inner surface and/or outer surface of the axial anvils 252 may be substantially planar to match the configuration of the cap 114 and/or the canister 112 of the canister assembly 110. In some embodiments, the inner surfaces 256 of the axial anvils 252 may be substantially centered on the longitudinal axis L. The canister assembly 110 and remaining portions of the cell assembly 200 may also be substantially centered about the longitudinal axis L. In some embodiments, at least some of the plurality of lateral anvils 254 and/or the axial anvils 252 may exhibit a tapered configuration as described above. In some embodiments, the change in surface area between the inner surface 256 and outer surface 255 (or angle θ between adjacent the lateral surfaces 258) of the plurality of lateral anvils 254 may be substantially the same as the change in surface area between the inner surface 256 and outer surface 255 of the plurality of axial anvils 252. In such embodiments, the substantially matching geometry between adjacent anvils may help to provide a substantially uniform flow of the CPM 140 and/or the pressure transmitting medium 120 therebetween during application of pressure to the cell assembly 200. The junction between any of the adjacent surfaces any of the internal anvils disclosed herein may include a corner, a chamfer, a cusp, or a fillet.

In some embodiments, the geometry (e.g., taper, shape, orientation, size, or combinations thereof) of the plurality of lateral anvils 254 may be different from the geometry of the plurality of axial anvils 252. In some embodiments, the taper of at least some of the lateral surfaces of the plurality of lateral anvils 254 may be different from the taper some of the other lateral anvils 254. In such embodiments, the difference in geometry between the pluralities of anvils 250 may be selectively configured to provide a desired flow characteristic of the CPM 140 and/or pressure transmitting medium 120 therebetween during application of pressure thereto. For example, the angle θ between two adjacent lateral (tapered) surfaces 258 of adjacent internal anvils 250 may be greater than 0 degrees and less than 90 degrees, such as about 0.05 degrees to about 0.5 degrees, about 0.5 degrees to about 1 degree, about 1 degree to about 1.5 degrees, about 1.5 degrees to about 2 degrees, about 2 degrees to about 2.5 degrees, about 2.5 degrees to about 3 degrees, about 3 degrees to about 4 degrees, about 4 degrees to about 5 degrees, about 1 degree to about 85 degrees, about 5 degrees to about 80 degrees, about 10 degrees to about 75 degrees, about 15 degrees to about 60 degrees, about 25 degrees to about 45 degrees, about 30 degrees, about 5 degrees to about 30 degrees, about 30 degrees to about 45 degrees, about 45 degrees to about 60 degrees, about 60 degrees to about 75 degrees, about 75 degrees to less than about 90 degrees, about 1 degree to about 60 degrees, greater than 0 degree to about 60 degrees, about 5 degrees, about 10 degrees, about 15 degrees, about 20 degrees, about 25 degrees, about 30 degrees, about 40 degrees, or about 45 degrees. In some embodiments, the angle θ between adjacent lateral surfaces 258 of the adjacent anvils 250 may be configured to selectively control the amount and speed of flow of CPM 140 and/or the pressure transmitting medium 120 from between the internal anvils 250. The angle θ between adjacent surfaces of the internal anvils 250 may facilitate shearing of the CPM 140 therebetween, which may reduce the gasket effect of the CPM 140 between the internal anvils and/or between the internal anvils and the canister assembly 110. For example, a large angle θ between adjacent lateral surfaces of lateral anvils 254 may allow the lateral anvils 254 to move inwardly toward the longitudinal axis L (as the CPM 140 is sheared therebetween) at a faster rate than adjacent internal anvils having a relatively smaller angle θ therebetween. While shown in FIG. 2C as substantially planar, in some embodiments, one or more of the lateral surface 258 may be planar, faceted, arcuate, or combinations of the foregoing. The planes, facets, and/or arcs of the lateral surfaces 258 may extend in any direction across the lateral surface 258 (e.g., laterally and/or longitudinally). For example, in some embodiments, adjacent lateral surfaces 258 of adjacent internal anvils 250 may each include an angled portion and a substantially parallel portion with respect to at least a portion of the lateral surface 258 of an adjacent internal anvil 250. That is to say, some lateral surfaces 258 may have a change of angle thereon as the surface extends radially away from the longitudinal axis L. In such embodiments, adjacent lateral surfaces 258 of adjacent internal anvils 250 may slope away or toward each other depending on the location of the vertex V of the angle θ formed therebetween. The substantially parallel portions of the adjacent lateral surfaces 258 of adjacent internal anvils 250 may serve to promote formation of a gasket of the CPM 140 between adjacent internal anvils 250 upon a selected amount of inward travel by the cubic press anvils and/or the internal anvils 250.

As shown in FIGS. 2B and 2C, the vertex V of the angle θ may be located internally in the cell assembly. That is, the vertex V may be located between the internal anvils 250 and the longitudinal axis L. In such embodiments, the gap between adjacent internal anvils 250 is radially outwardly increasing. In some embodiments (FIG. 3E), the vertex V may be located peripherally to the cell assembly, such as located outside of the internal anvils 250. In such embodiments, the gap between adjacent internal anvils 250 is radially outwardly decreasing. In some embodiments, adjacent lateral surfaces 248 of adjacent internal anvils 250 may exhibit compound angles, multiple angles (e.g., transitioning from a first angle θ to a second angle θ, internally located vertex to a peripherally located vertex, etc.), arcuate surfaces, or combinations of any of the foregoing. In some embodiments, the angle θ may be about 0 degrees such that adjacent lateral surfaces 248 are substantially parallel to one another.

While depicted as substantially planar in FIG. 2C, the inner surfaces 256 of the lateral anvils 254, or any other internal anvils 250, may exhibit non-planar configurations. FIG. 2CC is a cross-sectional view of an embodiment of a lateral anvil 254' taken along the plane 2CC in FIG. 2C. While FIG. 2C depicts a substantially planar inner surface 256, as shown in FIG. 2CC, in some embodiments, the lateral anvils 254' may include an arcuate (e.g., concave) inner surface 256'. The arcuate inner surface 256' may be configured to be substantially congruent or complementary (e.g., parallel and/or coaxial) to the lateral surface of the canister assembly 110, such as having a substantially or generally concentric configuration. In such embodiments, the inner surface 256' may apply a substantially uniform pressure to the surface of the canister assembly 110 (and the pressure transmitting medium 120 and/or the CPM 140 therebetween) via inner surface 256'. In such embodiments, tensile stresses on one or more portions of the inner surface of the internal anvils may be reduced or eliminated because the one or more portions of the (e.g., entire) inner surface may be placed under compressive stress as a function of the congruent shape of the inner surface to the canister assembly 110, the CPM 140, and/or pressure transmitting medium 120 adjacent thereto. In embodiments utilizing a substantially planar inner surface 256 (e.g., FIGS. 2A-2C), the pressure on the substantially planar inner surface 256 inwardly toward the substantially non-planar (e.g., cylindrical) canister assembly 110 may cause the inner surface 256 to undergo deformation and place portions of the anvil material at the inner surface 256 in compressive and/or tensile stress due to deformation of the inner surface 256 away from the canister assembly 110 in one or more directions.

In an embodiment, the inner surface (e.g., 256') of any of the internal anvils 250 may be substantially non-planar, such as concave or convex, and may be arcuate, or polygonal (e.g., faceted). The configuration of the plurality of anvils 250 may be configured to be substantially congruent to a portion of the outer surface of the canister assembly 110 or may contact the canister assembly 110 at specific points thereon (e.g., configured to contact one or more specific portions of the canister assembly 110).

In some embodiments, the outer surface 255 may be substantially planar. In some embodiments, the outer surface 255 may be substantially non-planar, such as concave or convex, and may be arcuate or polygonal (e.g., faceted). As shown in FIG. 2CC, in some embodiments, the outer surface 255 may be incongruent to the inner surface 256', such as not having the same surface shape (e.g., a concave inner surface 256' and a planar outer surface 255). In some embodiments (FIG. 2C), the outer surface 255 may be substantially parallel to the inner surface 256.

Figure 2D:
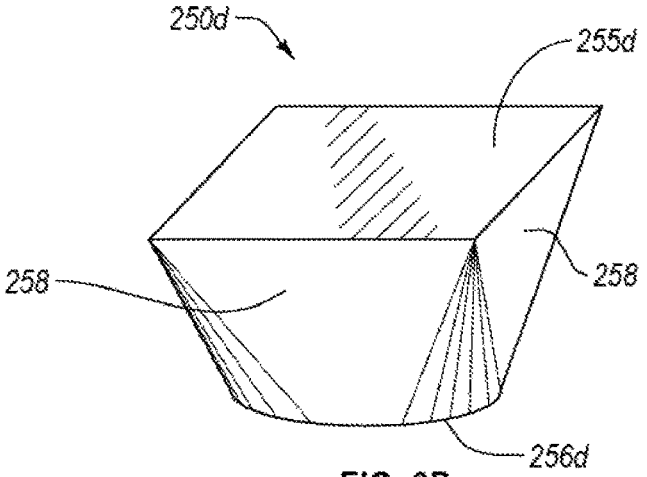
FIG. 2D is an isometric view of an internal anvil, according to an embodiment.
Figure 2E:
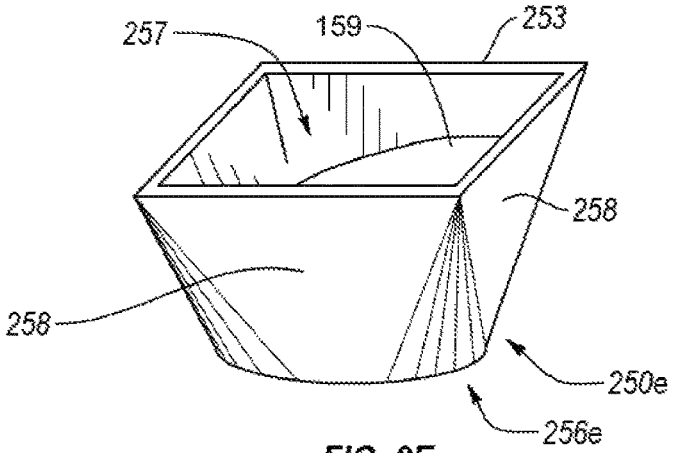
FIG. 2E is an isometric view of an internal anvil, according to an embodiment.

FIGS. 2D and 2E are isometric views of internal anvils 250*d* and 250*e*, according to embodiments. The internal anvils 250*d* and 250*e* may be configured as axial anvils and/or lateral anvils, as described herein. In some embodiments, an internal anvil may have a different cross-sectional shape at the inner surface than at the outer surface. For example, the internal anvil 250*d* may be configured with a substantially polygonal (e.g., rectangular) outer surface 255*d* and a curved (e.g., generally circular or generally elliptical) inner surface 256*d*, wherein the internal anvil 250*d* transitions from rectangular to curved across the thickness of the lateral surfaces 258. Geometries for the inner surface and outer surface may include circular, elliptical, polygonal (e.g., rectangular, pentagonal, etc.), symmetrical, non-symmetrical, or combinations of any of the foregoing. In some embodiments, the one or more internal anvils 250 may be configured with one or more of a different shape at the inner surface and the outer surface, a smaller surface area at the inner surface than at the outer surface, or a different planarity at the inner surface and the outer surface.

As shown in FIG. 2E, an internal anvil 250*e* may be configured as an electrically conductive container 253 having an inner surface 256*e* and at least one lateral surface 258. The inner surface 256*e* and at least one lateral surface 258 collectively define a recess 257 into which one or more anvil materials 159 may be disposed. The conductive container 253 may define a shell that may hold the anvil materials 159 therein during application of pressure. The conductive container 253 may include one or more metals or alloys such as iron, steel (e.g., stainless steel, A-2 tool steel, D-2 steel), chromium, osmium, titanium, vanadium, zirconium, one or more refractory metals (e.g., molybdenum, niobium, tantalum, or tungsten), any other metal, or alloys of any of the foregoing. The anvil materials 159 may include any anvil material(s) disclosed herein. In some embodiments, the anvil materials 159 may include a portion of CPM 140 (in combination with another material layer or mixture) and/or pressure transmitting medium disposed within the conductive material 253. The conductive container 253 may include a cap (not shown) which may be secured to the at least one lateral surface 258 to define the outer surface of the internal anvil 250*e* and seal the anvil materials 159 in the internal anvil 250*e*. Any of the internal anvils disclosed herein may be configured as the conductive container 253 with at least one anvil material 159 therein. The inner surface 256*e* of the internal anvil 250*e* may be incongruent to the outer surface (e.g., the inner surface 256*e* may be concave while the outer surface may be planar).

Figure 2F:
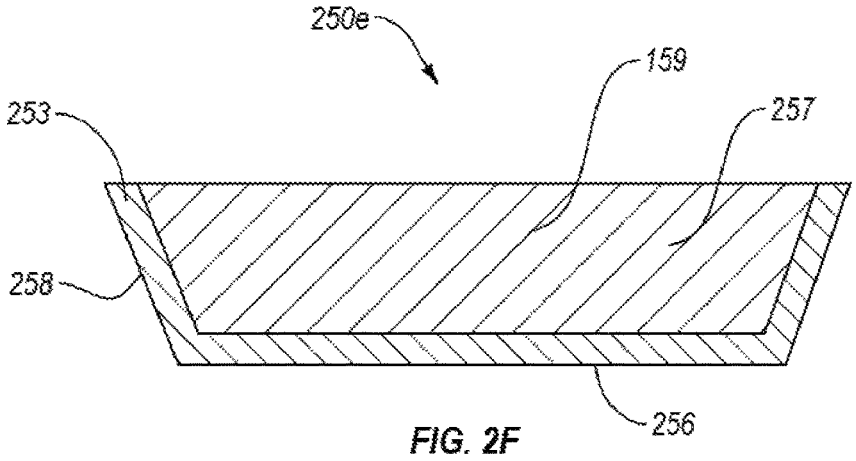
FIG. 2F is a side cross-sectional view of an internal anvil, according to an embodiment.
Figure 2G:
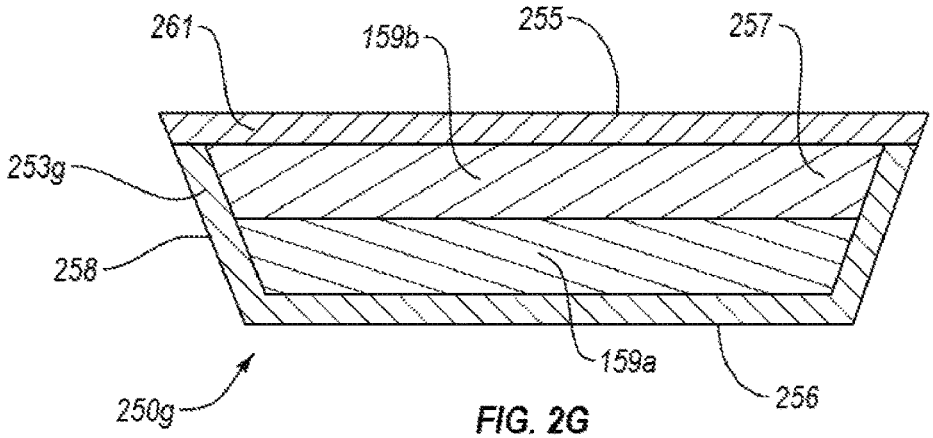
FIG. 2G is a side cross-sectional view of an internal anvil, according to an embodiment.

FIGS. 2F and 2G are side cross-sectional views of internal anvils, according to embodiments. FIG. 2F illustrates an internal anvil 250*f* having an electrically conductive container 253 including an inner surface 256 and at least one lateral surface 258 extending therefrom, collectively defining a recess 257. The recess 257 may be at least partially filled with an anvil material 159, such as up to the uppermost extent of the at least one lateral surface.

FIG. 2G illustrates an internal anvil 250*g* having an electrically conductive container 253*g*. The conductive container 253*g* may include an outer surface 255 substantially opposite the inner surface 256, and at least one lateral surface 258 extending therebetween, which may define the recess 257 therebetween (and at least partially form the shell of a substantially sealed internal anvil 250*g*). The recess 257 may be filled with a plurality of anvil materials 159*a* and 159*b*. The conductive container 253*g* may include a cap 261 associated therewith. The cap 261 may be constructed of the same material as the conductive container 253*g* and may be sized and configured to substantially seal the recess 257 of internal anvil 250*g*, such as across the outer surface 256 thereof. The anvil materials 159*a* and 159*b* may be similar or identical to any of the anvil materials 159 disclosed herein, where the first anvil material 159*a* is different in one or more aspects than the second anvil material 159*b*. For example, the first anvil material 159*a* may include a cemented tungsten carbide and the second anvil material

159*b* may include CPM. In an embodiment, the first anvil material 159*a* may include a diamond material (e.g., a polycrystalline diamond body) and the second anvil material 159*b* may include cell pressure medium such as up to the uppermost extent of the at least one lateral surface 258. The first anvil material 159*a* may be disposed in the conductive container 253*g* in a first layer and the second anvil material 159*b* may be disposed adjacent to the first anvil material 159*a* in a second layer. The first and second layers may at least partially fill the recess 257, such as up to the uppermost extent of the at least one lateral surface. The relative thicknesses of the layers of the first anvil material 159*a* and the second anvil material 159*b* may vary depending on the desired properties of the internal anvil 250*g*. In some embodiments, the internal anvil 250*g* may include more than two anvil materials.

Figure 3A:
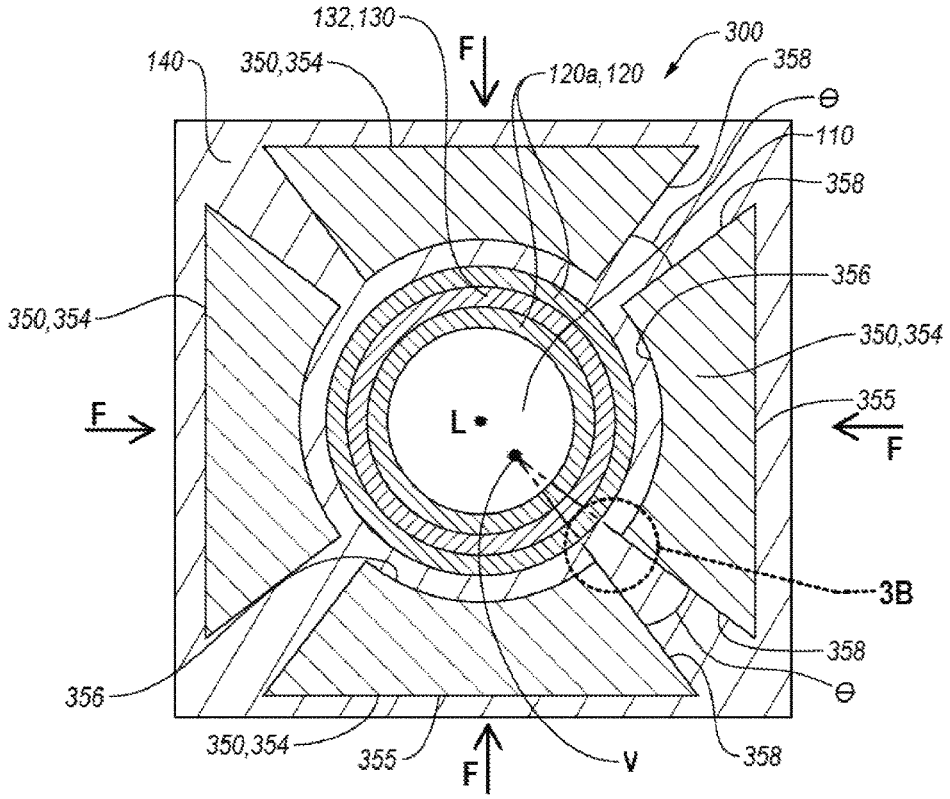
FIG. 3A is a top cross-sectional view of a portion of a cell assembly, according to an embodiment.

FIG. 3A is a top cross-sectional view of a portion of a cell assembly 300 taken along and substantially perpendicular to the longitudinal axis L, according to an embodiment. The cell assembly 300 may include one or more internal anvils 350, such as a plurality of lateral anvils 354. The cell assembly 300 includes the canister assembly 110 as described above. The longitudinal axis L is defined by and generally centered on the longitudinal axis of the canister assembly 110. The cell assembly 300 includes one or more layers of pressure transmitting medium 120, such as pressure transmitting medium tube 120*a* as disclosed above, which may be directly adjacent to and at least partially enclosing the canister assembly 110. In an embodiment, the heater tube 132 of heating element 130 (or one or more portions of heater element 130') as described above, may be disposed about and at least partially enclosing the pressure transmitting medium 120 tube 120*a* on the outside of the canister assembly 110. In an embodiment, an optional, second layer of pressure transmitting medium 120*a* may be disposed about and at least partially enclosing the heating element 130 (e.g., heater tube 132). The cell assembly 300 includes CPM 140 disposed about and at least partially enclosing the heating element 130 and/or pressure transmitting medium tube 120*a*. The CPM 140 may be similar or identical to any CPM disclosed herein.

At least some of the plurality of lateral anvils 354 are positioned internally to the CPM 140. The plurality internal anvils 350 include the plurality of lateral anvils 354 and a plurality of axial anvils (not shown). At least some of the plurality of lateral anvils 354 may be positioned at least partially internal to the CPM 140, such as being partially embedded therein or completely encapsulated therein. Each of the lateral anvils 354, the pressure transmitting medium 120, the heating element 130, and the canister assembly 110 may be disposed within a cavity formed in the CPM 140. Such cavities may be preformed by cutting, molding, lasing, or otherwise forming each of said cavities in a substantially coherent mass of CPM 140 (e.g., a temporarily bonded green state CPM body), such as in two halves of a whole CPM body (FIGS. 5A and 5B) which is assembled prior to HPHT processing. In some embodiments, each of the components of the cell assembly 300 may be embedded in the CPM 140 by sequentially placing each of the above noted cell assembly components in CPM powder while the CPM powder is poured into a mold, thereby filling in CPM material around each of the components and hold the same in place. The mold may be placed in the HPHT press, or the cell assembly therein may be removed therefrom and placed in an HPHT press.

The plurality of lateral anvils 354 each includes an inner surface 356 proximate to the canister assembly 110 and at least one outer surface 355 distal from the canister assembly 110 and configured to receive pressure from one or more anvils. Each lateral anvil 354 includes at least one lateral surface 358 extending between the inner surface 356 and the outer surface 355. The at least one lateral surface 358 may include one or more arcuate (e.g., substantially cylindrical) surfaces, one or more substantially planar surfaces, or combinations of the foregoing. Each of the plurality of lateral anvils 354 may be positioned circumferentially about the lateral surface of the canister assembly 110. The cell assembly 300 may include axial anvils (not shown) disposed adjacent to the upper surface and the lower surface of the canister assembly 110. As shown in FIGS. 1A-2B, 4A, and 5A, the inner surface and/or outer surface of the axial anvils may be substantially planar to match the configuration of the upper surface (of the cap 114) and the lower surface (of the canister 112) of the canister assembly 110.

In some embodiments, the angle θ between two adjacent lateral surfaces 358 of two adjacent internal anvils 350 (e.g., lateral anvils 354, or lateral anvil 354 and axial anvil (not shown in plane)), having a vertex V (e.g., the intersection point between the planes defined by adjacent lateral surfaces 358) between the internal anvils 350 and the longitudinal axis L, may be about greater than 0 degrees and less than 90 degrees as disclosed above. In such embodiments, the flow of CPM 140 from the center of the cell assembly 300 toward the outside of the cell assembly may be selectively controlled at least in part by the angle between the adjacent lateral surfaces 358 of the internal anvils 350. For example, when the angle θ is greater than 0 degrees and as pressure is applied to the cell assembly 300 by anvils of a cubic press, the CPM 140 material between the canister assembly 110 and the internal anvils 350 and the between adjacent internal anvils 350 may flow from the center of the cell assembly 300 outward. Such outward flow may be sped up or slowed down by the shape (e.g., angle θ and/or location of vertex V) and/or the size of the space (e.g., gap G) defined between adjacent lateral surfaces of internal anvils 350. For example, adjacent internal anvils having a relatively greater angle θ therebetween may allow more material to flow therefrom and/or at a greater rate than lateral surfaces 358 of internal anvils 350 having a lower angle θ therebetween. In some embodiments, the rate at which the pressure between the internal anvils 350 builds and/or is maintained (and is thereby delivered to the canister assembly 110) may be selectively controlled by the interaction between adjacent lateral surfaces 358 (e.g., the angle θ and/or vertex V between adjacent lateral surfaces 358).

Figure 3B:
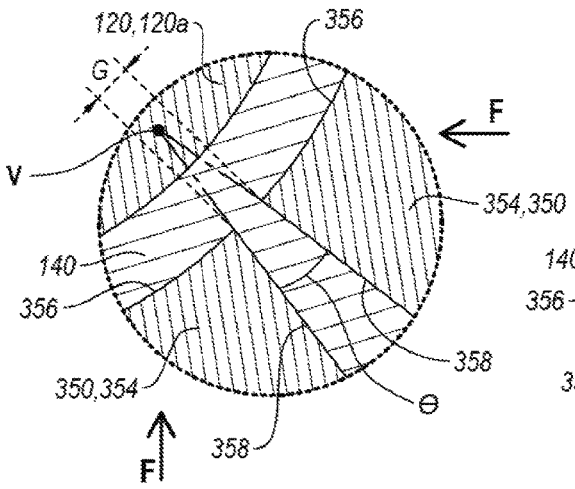
FIGS. 3B and 3C are enlarged, cross-sectional views of the region 3B shown in FIG. 3A, at different stages during compression of the cell assembly of FIG. 3A, according to an embodiment.
Figure 3C:
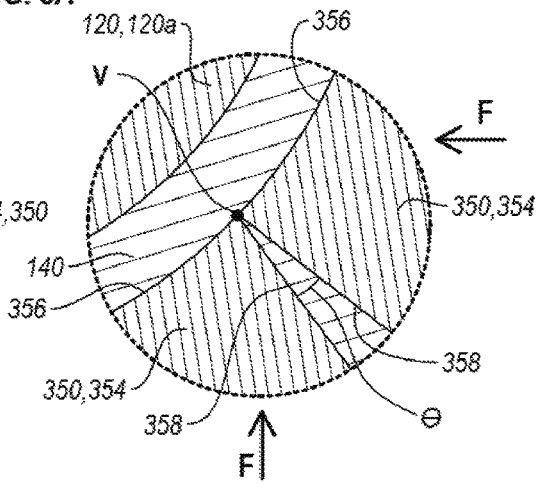

FIGS. 3B and 3C are enlarged, cross-sectional views of region 3B shown in FIG. 3A at different stages during compression of the cell assembly 300, according to an embodiment. The region 3B includes the inner surfaces 356 and lateral surfaces 358 of adjacent lateral anvils 354. FIG. 3B depicts region 3B prior to application of pressure to the internal anvils 350 by a cubic press. The lateral anvils 354 are separated by a gap G between the closest surfaces (e.g., adjacent lateral surfaces 358) of adjacent internal anvils 350 (e.g., lateral anvils 354). Upon application of forces F, each respective lateral anvil 354 is forced toward the center of the cell assembly 300, and the gap G is reduced.

The initial distance of the gap G may be configured to allow a selected amount of movement of each internal anvil (e.g., lateral and/or axial anvil) toward the center (e.g., the longitudinal axis L) of the cell assembly 300, thereby compressing the contents of the cell assembly 300 therebetween. The gap G in an unpressed cell assembly 300 may be 0.1 μm or more, such as about 0.1 μm to about 2 cm, about 1 μm to about 1 cm, about 10 μm to about 750 μm, about 100 μm to about 500 μm, about 1 μm to about 500 μm, about 500 μm to about 1 cm, about 1 cm to about 2 cm, less than about 2 cm, or less than 1 cm. As pressure is applied and the internal anvils 350 are compressed inward, the CPM 140 between the internal anvils may begin to deform and flow through the gap G. As noted above, the angle θ between adjacent lateral surfaces 358 of adjacent internal anvils 350 may at least partially control or influence the speed and/or volume of CPM 140 that flows radially outward through the gap G. For example, with adjacent lateral surfaces 358 having an internally located vertex V (e.g., between the internal anvils 350 and the longitudinal axis L), a smaller angle θ (e.g., about 5 degrees) may provide a relatively slow flow of material from the region between the internal anvils 350, and from between the internal anvils 350 and the canister assembly 110, while a relatively greater angle θ may allow for a faster or greater flow of CPM 140. As the internal anvils 350 travel inward, the gap G may be reduced and the vertex V may move from a point adjacent to the longitudinal axis L outward toward the internal anvils 350. In some embodiments, the internal anvils 350, the CPM 140, the pressure transmitting medium 120 (e.g., pressure transmitting medium tube 120*a*), the heating element 130, and the canister assembly 110 may be sized, positioned, and/or configured to cause the internal anvils 350 to contact one another upon a selected amount of applied pressure (and by extension a selected amount of travel of the internal anvils 350).

FIG. 3C depicts region 3B subsequent to application of pressure to the internal anvils 350 by the anvils of the cubic press. As the internal anvils 350 travel inwardly, the forces F pushing the internal anvils 350 from six different directions (cubic pressure from the anvils of the cubic press) may cause the internal anvils 350 to contact or otherwise converge along at least a portion of the lateral surfaces 358 thereof, thereby reducing or eliminating the gap G therebetween (and causing the vertex V to move to approximately the intersection of adjacent internal anvils 350. In such embodiments, the CPM 140 may be trapped between the internal anvils 350 and the canister assembly 110, the pressure transmitting medium 120, and the heating element 130 (e.g., upon the collision of the internal anvils 350 or upon the CPM 140 "locking" in a small gap between the internal anvils 350). The trapped CPM 140 may cause the pressure to build between the internal anvils 350 and the canister assembly 110, the pressure transmitting medium 120, and the heating element 130 more so than when the CPM 140 is allowed to flow (or more freely flow) therebetween. As the internal anvils 350 travel inwardly, the angle θ may remain substantially the same (discounting any deformation due to contact of the adjacent anvils).

In some embodiments, the amount of CPM 140 in the unpressed cell assembly 300 between the internal anvils 350 and the canister assembly 110, the pressure transmitting medium 120, and the heating element 130, may be configured to allow a specified amount of inward travel of each of the internal anvils 350. Such amount of the CPM 140 may be configured to provide a specific amount of the CPM 140 flow through the gap G and/or a specified amount of inward travel of the internal anvils 350 prior to contact or a selected gap G developing therebetween. For example, the volume of the CPM 140 between the outermost surface of the canister assembly 110, the pressure transmitting medium 120 (e.g., pressure transmitting medium tube 120*a*), or the heating element 130 may be about 0.1 μm thick or more, such as about 0.1 μm to about 2 cm, about 1 μm to about 1 cm, about 10 μm to about 750 μm, about 100 μm to about 500 μm, about 1 μm to about 500 μm, about 500 μm to about 1 cm, about 1 cm to about 2 cm, less than about 2 cm, or less than 1 cm thick. The thickness of the CPM 140 throughout the unpressed cell assembly 300 may be substantially uniform between one or more portions of the cell 300 assembly, or may be non-uniform between one or more portions and one or more other portions of the cell assembly 300.

Figure 3D:
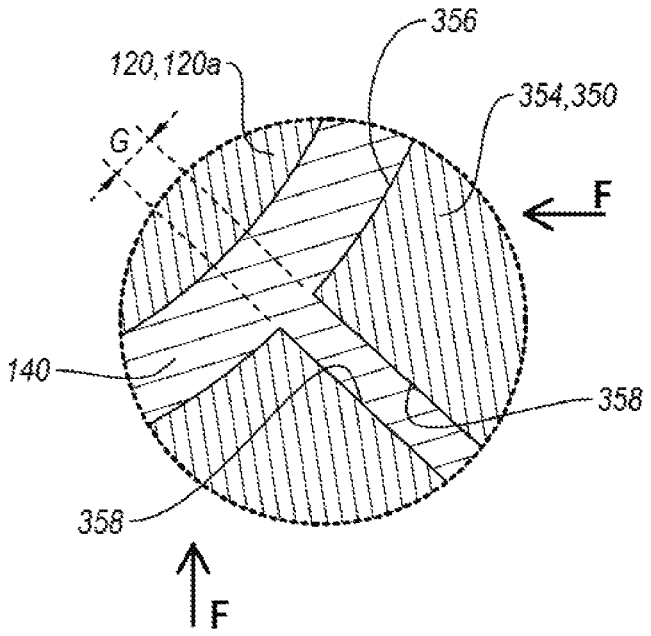
FIGS. 3D and 3E are enlarged, cross-sectional views of the region 3B shown in FIG. 3A, according to different embodiments.
Figure 3E:
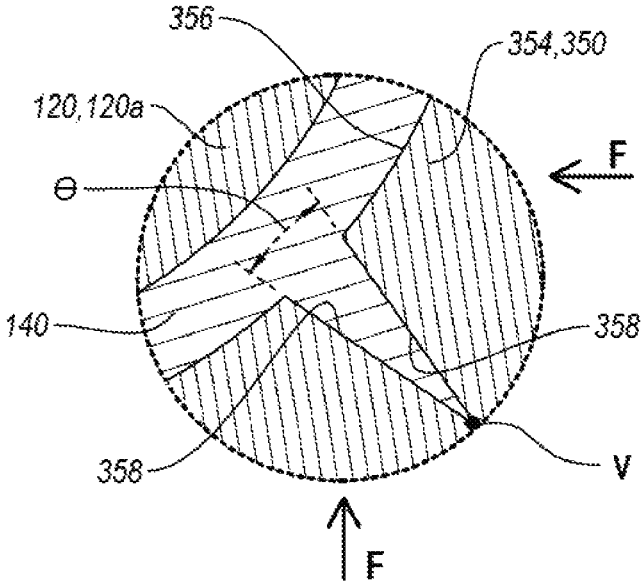

In some embodiments, adjacent lateral anvils and/or axial anvils may have a substantially parallel or radially outwardly decreasing gap (e.g., having a vertex V outside of the internal anvils) therebetween FIGS. 3D and 3E are enlarged, cross-sectional views of region 3B having different lateral surface 358 configurations than FIGS. 3A-3C, according to various embodiments. The region 3B includes the inner surfaces 356 and lateral surfaces 358 of adjacent lateral anvils 354. FIG. 3D depicts adjacent lateral anvils 354 having substantially parallel lateral surfaces 358 relative to the adjacent lateral anvil 354. The lateral anvils 354 are separated by a gap G between the closest surfaces (e.g., adjacent lateral surfaces 358) of adjacent internal anvils 350 (e.g., lateral anvils 354). Upon application of forces F, each respective lateral anvil 354 is forced toward the center of the cell assembly 300, and the gap G is reduced. If the lateral surfaces 358 are parallel, the gap G may be reduced sufficient to cause the CPM 140 to cease to flow (e.g., "locking up") therebetween.

FIG. 3E depicts region 3B having a radially outwardly decreasing gap G therebetween. The peripherally located vertex V (e.g., located outside of the internal anvils 350 distal from the longitudinal axis L) may provide a different flow and/or pressure profile than an internally located vertex V. As the internal anvils 350 travel inward, the forces F pushing the internal anvils 350 from six different directions (cubic pressure from the cubic press) may cause the internal anvils 350 to contact or otherwise converge on at least a portion of the lateral surfaces 358 thereof, thereby reducing or eliminating the gap G therebetween. In such embodiments, the CPM 140 may be trapped between the internal anvils 350 and the canister assembly 110, the pressure transmitting medium 120 (e.g., pressure transmitting medium tube 120*a*), and the heating element 130 (e.g., heater tube 132), upon inward movement or contact of the internal anvils 350. The trapped CPM 140 may cause the pressure to build between the internal anvils 350 and the canister assembly 110, the pressure transmitting medium 120, and the heating element 130, more so than when the CPM 140 is allowed to flow (or more freely flow) therebetween. As the internal anvils 350 travel inward, the angle θ may remain substantially the same (discounting any deformation due to contact of the adjacent anvils). Configurations having the peripherally located vertex V may cause or allow less CPM 140 to flow outward from between the internal anvils 350 and the pressure transmitting medium 120, which may cause pressure to build faster in the cell assembly 300 than in a cell assembly having an internally located vertex V.

Figure 4A:
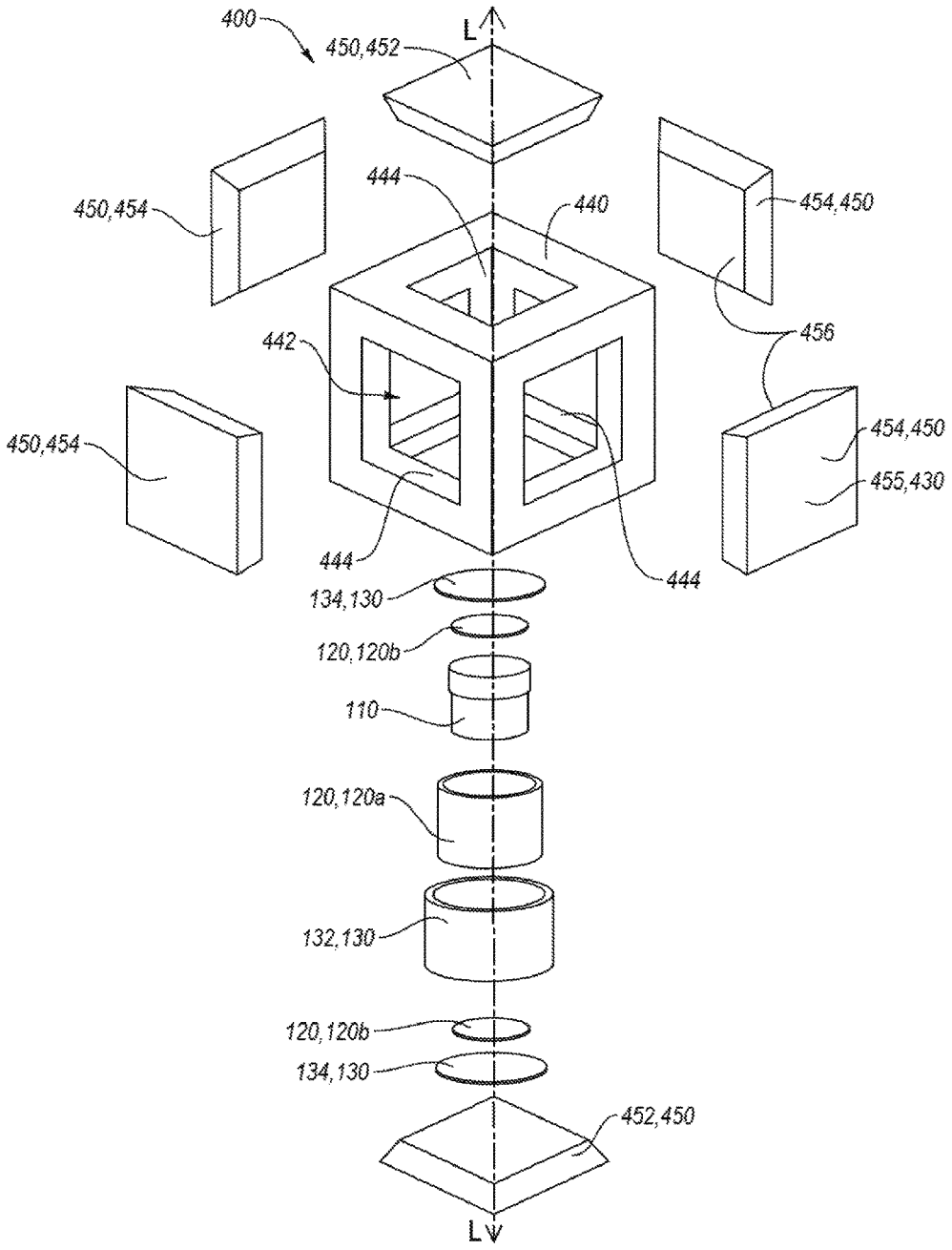
FIG. 4A is an exploded, isometric view of a cell assembly including a green state CPM, according to an embodiment.
Figure 5A:
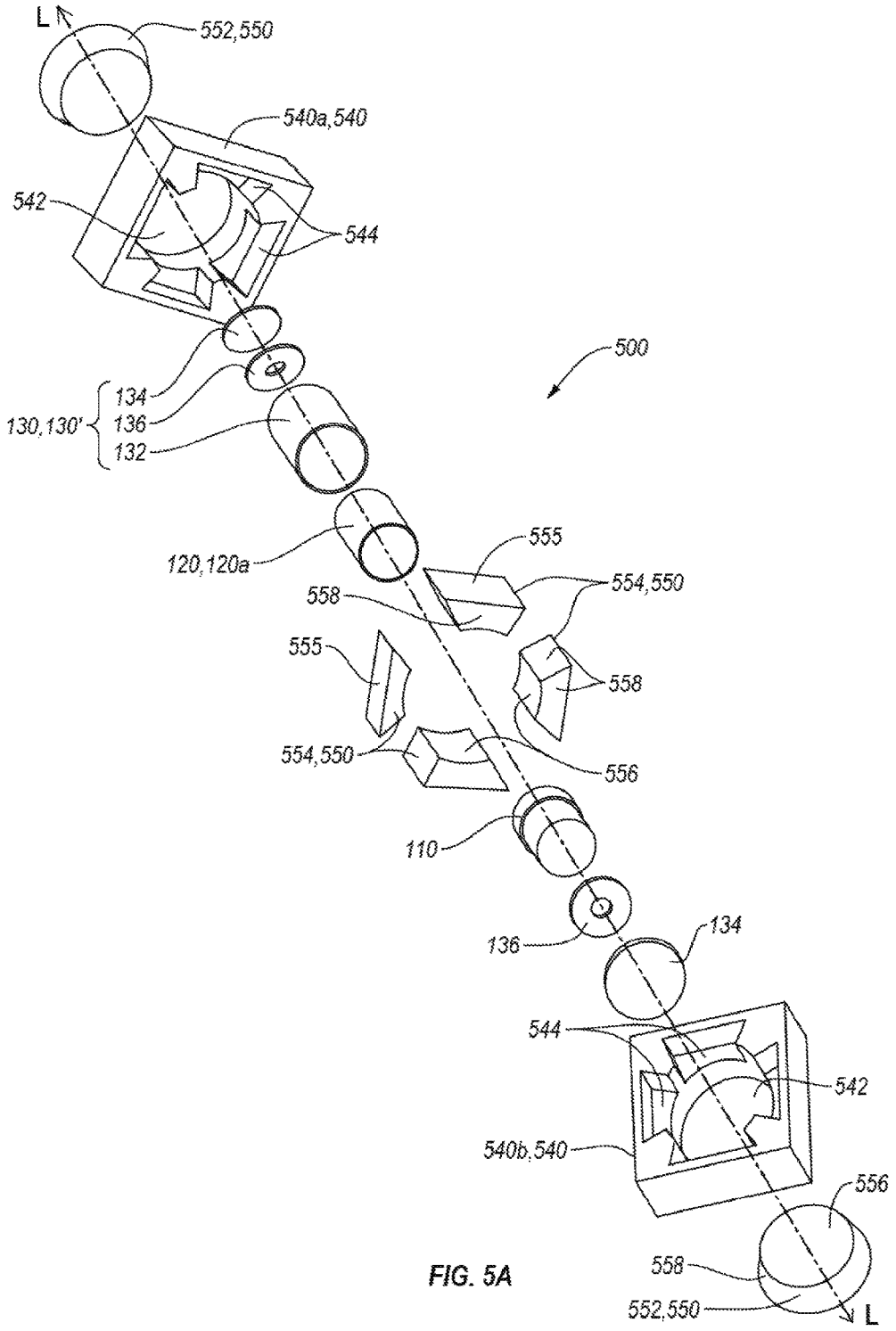
FIG. 5A is an exploded, isometric view of a cell assembly including two halves of a green state CPM, according to an embodiment.

FIGS. 4A and 5A are exploded, isometric views of cell assemblies having at least one green state CPM, according to embodiments. One or more of a plurality of internal anvils, one or more portions of pressure transmitting medium, a heating element, or a canister assembly may be positioned within the green state CPM(s). In some embodiments, a CPM may be formed into at least one green state CPM, such as by cold pressing a volume of CPM particles into at least one green state CPM defining a coherent volume of particles in a defined shape and that are not permanently bonded together. In some embodiments, an adhesive or binder may be added to the volume of CPM particles to form the at least one green state CPM. The at least one green state CPM may be formed into a specific shape by one or more of pressing, molding, machining (e.g., milling or grinding), lasing, punching, trimming, etc. The outer shape of the at least one green state CPM may be substantially cuboid, cubic, spherical, elliptical, or combinations of any of the foregoing.

One or more cavities (e.g., recesses) may be formed in the at least one green state CPM during or after formation of the at least one green state CPM. For example, at least one central cavity may be formed in substantially the center of the at least one green state part by molding or by removing the CPM from the center of a solid at least one green state CPM. The at least one central cavity may be configured to receive, hold, at least partially surround, or otherwise enclose one or more portions of pressure transmitting medium 120, heating element 130, and a canister assembly 110 therein. A plurality of anvil cavities may be formed in the at least one green state part, such as surrounding the at least one central cavity. The plurality of cavities including the central cavity and anvil cavities may be made by molding or by removing the CPM from the at least one green state CPM. Each of the plurality of anvil cavities (e.g., recesses) may be configured to receive and/or hold at least a portion of a respective one of the plurality of internal anvils (e.g., axial anvils and/or lateral anvils).

Figure 4B:
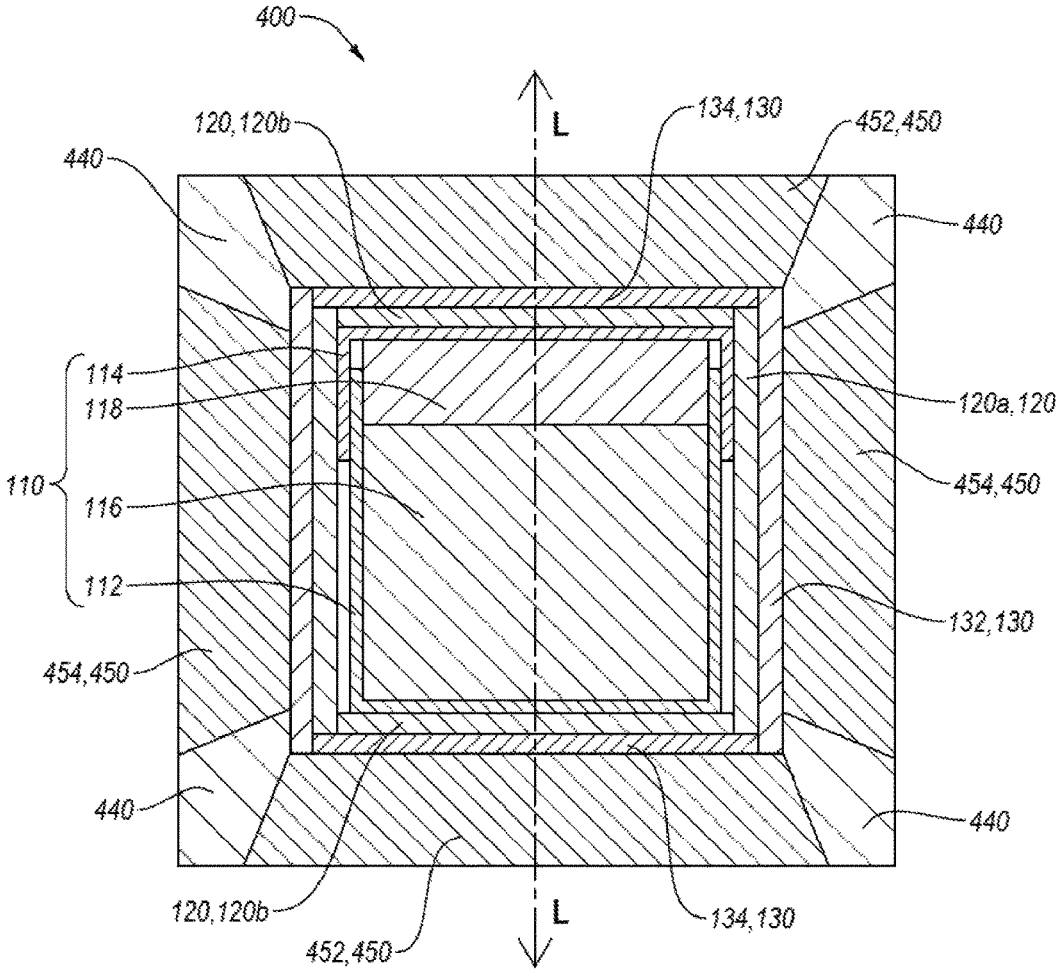
FIG. 4B is an assembled, side cross-sectional view of the cell assembly of FIG. 4A.

FIG. 4A is an exploded isometric view of cell assembly 400 including a green state CPM 440 (e.g., a coherent mass of CPM particles having a specific geometric shape), a plurality of internal anvils 450 including axial anvils 452 and lateral anvils 454, one or more portions of pressure transmitting medium 120 (e.g., pressure transmitting medium tube 120*a* and pressure transmitting medium cap, disc, or plug 120*b*), heating element 130, and a canister assembly 110. FIG. 4B is an assembled, side cross-sectional view of the cell assembly 400. The axial anvils 452 or lateral anvils 454 may be similar or identical to any of the axial or lateral anvils described herein.

The green state CPM 440 includes a substantially cubic configuration having eight corners and twelve beams extending therebetween collectively defining a central, central cavity 442 and six anvil cavities 444 therein. The cavities 442 or 444 may be recesses in and/or cut-outs of one or more portions of the green state CPM 440. The central cavity 442 may be positioned in the center of the green state CPM 440 (one or both of longitudinally or laterally centered). The central cavity 442 may be configured to receive, hold, at least partially surround, or enclose one or more of the canister assembly 110, the pressure transmitting medium 120, or the heating element 130. The anvil cavities 444 may each be substantially centered between a respective set of four corners of the green state CPM 440 on an inner surface thereof. The anvil cavities 444 may be positioned around the central cavity 442 of the green state CPM 440. The anvil cavities 444 may resemble window frames formed into an outer surface of the green state CPM 440. Each of the anvil cavities 444 may be sized and configured to substantially match the shape (e.g., the lateral dimensions) of an associated respective internal anvil 450. Each of the anvil cavities 444 are configured to receive, hold, at least partially surround, or otherwise encompass a corresponding one of the internal anvils 450 therein. In some embodiments, each of the anvil cavities 444 may exhibit substantially the same shape. In some embodiments, each or some of the anvil cavities 444 may exhibit substantially different shapes, such as different shapes for the axial anvils 452 and the lateral anvils 454 (FIG. 5A). For example, while shown as substantially prismatic (e.g., cuboid), one or more of the anvil cavities 444 and/or the central cavity 442 may be at least partially round or elliptical (e.g., cylindrical). Each of the cavities disclosed herein may be positioned and configured in the green state CPM 440 to provide the selected angle θ and/or gap G between adjacent internal anvils 450, such as any of those angles θ or gaps G disclosed above in relation to FIGS. 3A-3C. In some embodiments, the outer surfaces 455 of the internal anvils 450 may collectively define a substantially cubic configuration, which may be positioned and configured to correspond to anvils from a cubic press. In some embodiments, the inner surfaces 456 of at least some of the internal anvils 450 may collectively define a substantially cubic internal configuration. In some embodiments, the inner surfaces 456 of at least some of the internal anvils 450 may collectively define a substantially cylindrical configuration.

The canister assembly 110 may be positioned within the central cavity 442. The pressure transmitting medium tube 120*a* (e.g., salt liner) may be positioned about the canister assembly 110, the heating element 130 including a heater tube 132 and/or one or more end heaters 134 may be positioned over the pressure transmitting medium 120 (e.g., pressure transmitting medium tube 120*a* and/or pressure transmitting medium cap 120*b*) extending around the canister assembly 110, and an optional second layer of pressure transmitting medium 120 may be positioned about the heating element 130. All or some of such components may be positioned at least partially in the central cavity 442. The plurality of internal anvils 450 may be positioned at least partially within the anvil cavities 444. In some embodiments, additional CPM may be added to the one or more cavities in the green state CPM 440 after the canister assembly 110 and surrounding materials disclosed above and/or internal anvils 450 are positioned in their respective cavities 444. For example, powder CPM may be poured therein and/or green state CPM shims, disks, foils, or other coherent CPM portions may be placed between the anvils and the outermost portion of the heating element 130 (e.g., heater tube 132) or pressure transmitting medium 120 (e.g., pressure transmitting medium tube 120*a* and/or pressure transmitting medium cap or plug 120*b*). Such additional CPM may generally or substantially fill any remaining empty volume in the cell assembly 400, such as between the outermost layer around the canister assembly 110 (e.g., the pressure transmitting medium 120 or the heating element 130) and one or more of the internal anvils 450. In at least some embodiments, the inner surface 456 of at least some of the internal anvils 450 may be completely internal (e.g., completely enclosed) to the unpressed CPM 440. In some embodiments, the outer surface 455 may be exposed (e.g., not entirely enclosed within the unpressed cell CPM 440).

In some embodiments, the one or more of the internal anvils may be entirely enclosed within the CPM, such as having the inner surface 456, lateral surfaces 458, and outer surface 455 completely enclosed within the CPM. In some embodiments, a green state CPM may include two or more portions (e.g., halves, thirds, quarters, etc.), each having one or more cavities therein.

Figure 5B:
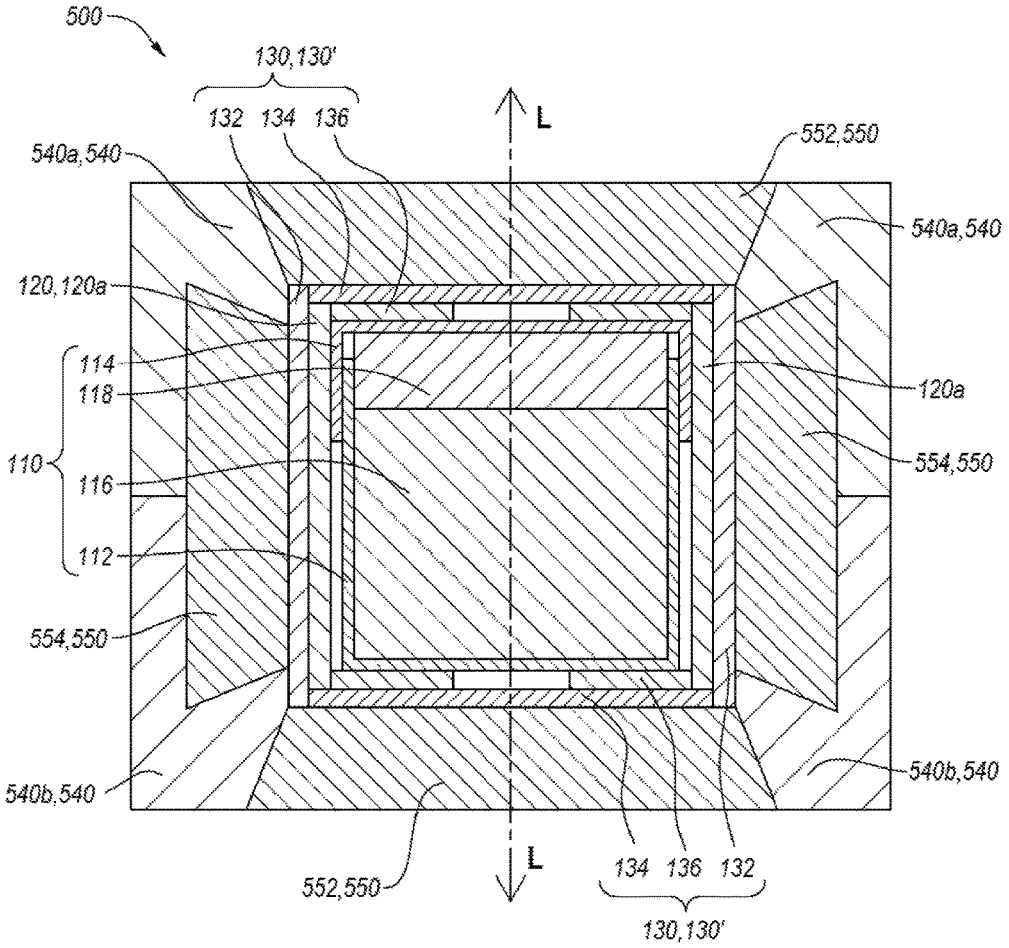
FIG. 5B is an assembled side cross-sectional view of the cell assembly of FIG. 5A.

FIG. 5A is an exploded, isometric view of a cell assembly 500 including a green state CPM 540 having two halves 540*a* and 540*b*, a plurality of internal anvils 550 including axial anvils 552 and lateral anvils 554, one or more portions of pressure transmitting medium tube 120*a*, heating element 130 and/or 130' (depicted in FIGS. 5A and 5B with both) (including heater tube 132 (in the case of heating element 130), end heater(s) 134, and/or gasket element(s) 136 (in the case of heating element 130')), and a canister assembly 110. FIG. 5B is an assembled, side cross-sectional view of the cell assembly 500. The axial anvils 552 and/or lateral anvils 554 may be similar or identical to any of the axial or lateral anvils described herein.

The green state CPM 540 includes two halves 540*a* and 540*b* of coherent CPM material (e.g., CPM 140) collectively defining a generally central cavity 542 and a plurality (e.g., six) of anvil cavities 544 therein. Each half 540*a* and 540*b* includes at least a portion of at least one preformed cavity therein. For example each half 540*a* and 540*b* may include half of the collective complete central cavity 542 therein. The at least one preformed cavity may include one or more of the central cavity 542 or the one or more anvil cavities 544. The cavities 542 or 544 may be recesses in or cut-outs of one or more portions of the green state CPM 540. The central cavity 542 may be configured to receive, hold, at least partially surround, or enclose one or more of the canister assembly 110, the pressure transmitting medium 120 (e.g., pressure transmitting medium tube 120*a* and/or pressure transmitting medium cap, disc, or plug 120*b* (not shown)), or the heating element 130 and/or 130'. In an embodiment, the central cavity 542 may be positioned in substantially the center of each of the halves 540*a* and 540*b* of the green state CPM 540 (laterally centered therein and configured to provide half of a longitudinally generally centered cavity to the combined halves 540*a* and 540*b*).

In an embodiment, the anvil cavities 544 may be substantially centered between respective end surfaces of each of the halves 540*a* and 540*b*. Further, the anvil cavities 544 may be positioned (e.g., circumferentially spaced) about the central cavity 542, whether the central cavity 542 is centered or not. In an embodiment, each half 540*a* and 540*b* may define about half of each collective anvil cavity 544. When assembled, the anvil cavities in the halves 540*a* and 540*b* collectively define the anvil cavity 544 for each respective internal anvil 550. The anvil cavities 544 may be configured to substantially correspond (e.g., match) to the shape any of the internal anvils disclosed herein, including any combination of inner surfaces, lateral surfaces, or outer surfaces disclosed herein. For example, the anvil cavities 544 for the lateral anvils 554 may be configured to match the concave contour of the inner surface 556, the substantially planar outer surface 555, and the lateral surfaces 558 therebetween. In some embodiments, each of the anvil cavities 544 may exhibit substantially the same shape. In some embodiments, each of the anvil cavities 544 may exhibit substantially different shapes, such as different shapes for the axial anvils 552 and the lateral anvils 554. For example, the lateral anvil cavities 544 may be at least partially prismatic (e.g., cuboid, trapezoidal prismatic, etc.) and the axial anvil cavities 544 may be substantially round (e.g., frustoconical, cylindrical, etc.), each configured to match the shape of the corresponding internal anvil 550. At least some of the CPM 540 may be positioned between the outer surface 555 of at least some of the internal anvils 550 and lateral surface of the cell assembly 500.

In some embodiments, the green state CPM 540 and each of the anvil cavities 544 and the internal anvils 550 disposed therein may be configured (e.g., shaped and positioned) to form the cell assembly 500, with the internal anvils 550 having at least one of a selected gap between lateral surfaces 558 thereof prior to application of pressure, a selected angle between adjacent lateral surface 558, a selected amount (e.g., thickness) of CPM 540 between the internal anvils 550 and the pressure transmitting medium 120 and/or heating element 130 and/or 130', or a selected amount of movement (e.g., inward travel) of the internal anvils 550 before they at least partially contact one another. The gaps and/or angles between adjacent internal anvils 550 may include any values for the gaps and/or angles described herein.

In some embodiments, all of the internal anvils 550, the CPM 540 including the central cavity 542 and the anvil cavity 544 therein may be configured to form a substantially sealed region (e.g., upon at least partial contact of the internal anvils 550 or upon "locking" of the CPM 540 in the gaps between the internal anvils 550). For example, each of the internal anvils 540 (e.g., axial anvils 552 and lateral anvils 554) may be positioned and configured within the CPM 540 to contact one another upon application of force from a cubic press, which may close all of the gaps between adjacent internal anvils, thereby forming the substantially sealed region. The substantially sealed region may contain substantially only one or more portions of the CPM 540, one or more portions of pressure transmitting medium 120, heating element 130 and/or 130', and/or the canister assembly 110. In some embodiments, substantially no CPM 540 may be positioned between the central cavity 542 and one or more of the anvil cavities 544. In some embodiments (not shown), at least some CPM 540 may be positioned between the central cavity 542 and one or more of the anvil cavities 544. In some embodiments, additional CPM 540 (e.g., in powder, foil, and/or wafer form) may be positioned between the internal anvils 550 and the outermost of the pressure transmitting medium 120 (e.g., pressure transmitting medium tube 120*a* and/or pressure transmitting medium cap, disk, or plug 120*b*) or heating element 130 and/or 130'.

In some embodiments, the outer surfaces 555 of the internal anvils 550 may collectively define a substantially cubic configuration (e.g., lying on or adjacent to the cubic surfaces of the CPM 540), which may be positioned and configured to correspond to anvils from a cubic press. As shown in FIG. 5A, in some embodiments, the inner surfaces 556 of the internal anvils 550 may collectively define a substantially cylindrical internal configuration. In some embodiments, the inner surfaces 556 of the internal anvils 550 may collectively define a substantially cubic, elliptical, or polygonal internal configuration.

In some embodiments, a cell assembly may include more than six internal anvils and the green state CPM may have more than six anvil cavities. In some embodiments, a cell assembly may include at least ten internal anvils and the green state CPM may have ten or more anvil cavities. In some embodiments, a cell assembly may include four or more lateral anvils, such as 8 lateral anvils or more. For example, a cell assembly may include more than one radial layer of lateral anvils, such as a set of inner lateral anvils (i.e., positioned generally about the entire circumference of the canister assembly) and a set of outer lateral anvils disposed about the inner lateral anvils. In another embodiment, a plurality of lateral anvils (e.g., 2 or more, 4 or more, 8 or more, 10 or more, 12 or more, 15 or more, or less than 15) may comprise one or more sets of lateral anvils. The one or more sets of lateral anvils may be radially layered about the longitudinal axis L and/or the canister assembly 110. In some embodiments (not shown), a plurality of axial anvils (e.g., 2 or more, 4 or more, 8 or more, 10 or more, 12 or more, 15 or more, or less than 15) may comprise one or more sets of axial anvils. The axial anvils may be axially layered around the canister assembly and/or the longitudinal axis L, such as the first set of axial anvils being positioned axially proximate to the canister assembly and the second set of axial anvils being positioned axially distal from the canister assembly.

Figure 6:
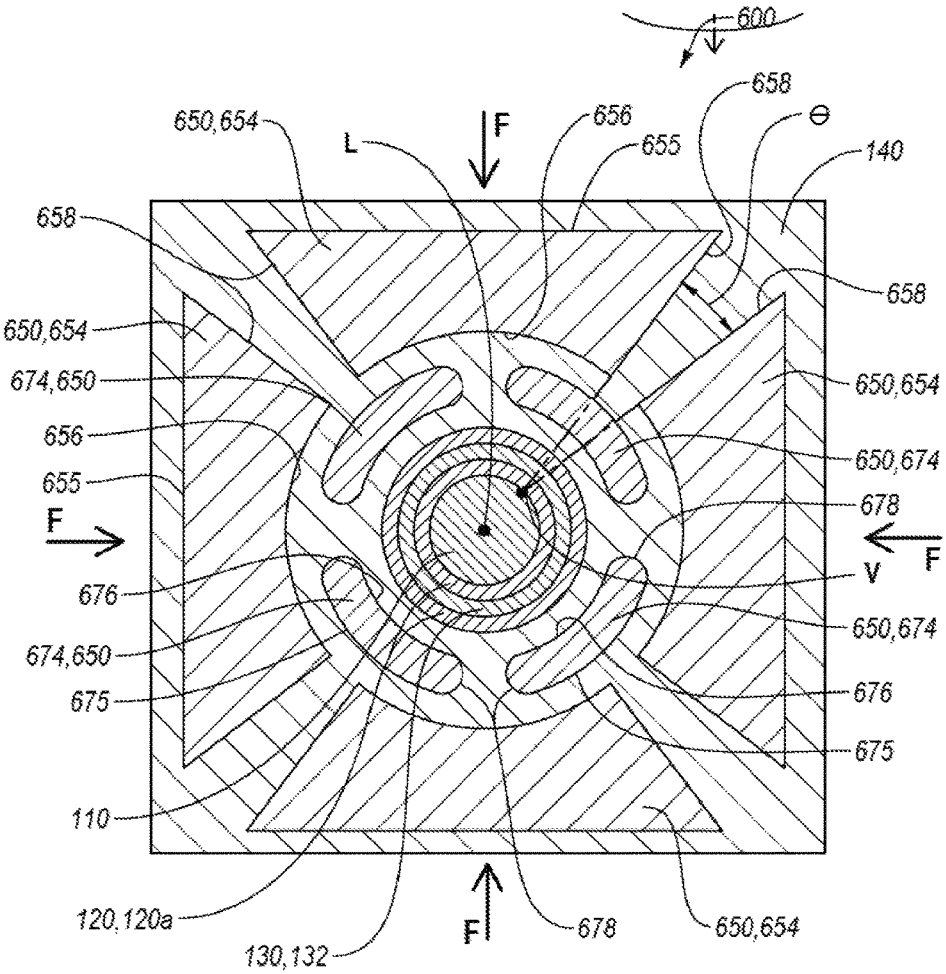
FIG. 6 is a top cross-sectional view of a cell assembly, according to an embodiment.
Figure 7:
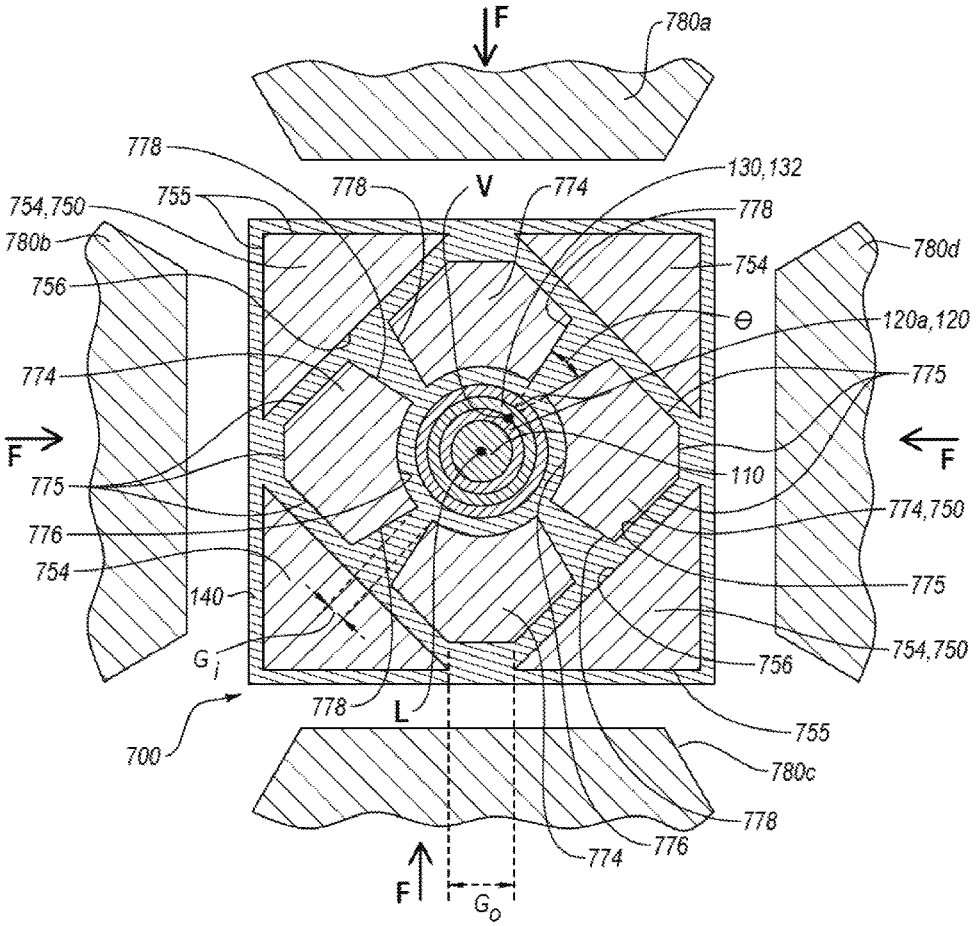
FIG. 7 is a top cross-sectional view of a cell assembly, according to an embodiment.

FIGS. 6 and 7 are top cross-sectional views of cell assemblies having more than six internal anvils, according to embodiments. By including more than one set of generally concentrically layered internal anvils, the cell assemblies of FIGS. 6 and 7 may provide a progressive increase in pressure toward the center of the cell assembly (e.g., the canister assembly 110). FIG. 6 is a top cross-sectional view of the cell assembly 600. The cell assembly 600 includes a plurality of internal anvils 650 positioned about longitudinal axis L. The plurality of internal anvils 650 includes a plurality of outer lateral anvils 654, a plurality of inner lateral anvils 674, and a plurality (e.g., two or more) of axial anvils (not shown). The cell assembly 600 includes a canister assembly 110, one or more portions of pressure transmitting medium 120 (e.g., pressure transmitting medium tube 120*a* as shown) disposed about the canister assembly 110, and heating element 130 (shown in FIGS. 6 and 7 as heating tube 132, but may in some embodiments be heating element 130' described above) disposed about at least an inner portion of pressure transmitting medium 120, each as disclosed herein above. The plurality of inner lateral anvils 674 may be disposed adjacent to and about at least a portion the canister assembly 110, one or more portions of pressure transmitting medium tube 120*a*, and heating element 130; and/or between any of the same and the plurality of outer lateral anvils 654. For example, the inner lateral anvils 674 may be substantially equidistantly spaced about and/or generally concentric to the lateral surface of the canister assembly 110. Such components may be at least partially internal to (e.g., embedded within) the CPM 140. In some embodiments, the outer lateral anvils 654 and/or the axial anvils (not shown) may be at least partially within the CPM 140, such as having an inner surface internal to the CPM and an outer surface protruding therefrom or coplanar with a surface of the CPM 140.

The inner lateral anvils 674 include an inner surface 676 proximate to the canister assembly 110 and an outer surface 675 radially spaced from the inner surface 676 with respect to the longitudinal axis L. The inner surface 676 of the inner lateral anvils 674 may be curved (e.g., concave or convex). In some embodiments, the inner surface 676 of the inner lateral anvils 674 may have a curvature substantially complementary or congruent to the curvature of the lateral surface of the canister assembly 110 or one or more components therebetween (e.g., the pressure transmitting medium tube 120*a*). For example, the inner surfaces 676 of the inner lateral anvils 674 may collectively define a portion of a substantially cylindrical or spherical configuration, at least partially into which the canister assembly 110, the pressure transmitting medium, the heating element 130 (e.g., heater tube 132), and one or more additional materials may be disposed. In some embodiments, the inner surfaces 676 of the inner lateral anvils 674 may collectively define a portion of a substantially cubic internal configuration. In some embodiments, the outer surfaces 675 of the inner lateral anvils 674 may collectively define a portion of a substantially cuboid (e.g., cubic), cylindrical, spherical, or other geometric configuration.

In some embodiments, the outer surface 675 of the inner lateral anvils 674 may be substantially congruent (e.g., parallel) with the inner surface 676 thereof. In some embodiments, the outer surface 675 of the inner lateral anvils 674 may have a different shape than the inner surface 676 thereof, such as having a substantially planar configuration while the inner surface 676 has an arcuate (e.g., concave) configuration, or vice versa. The inner surface 676 and/or the outer surface 675 may exhibit any of the configurations for an inner surface or outer surface described above with respect to any of the anvils herein, such as internal anvils 250. In the illustrated embodiment, the inner lateral anvils 674 may have one or more curved or arcuate lateral surfaces 678. However, in some embodiments, one or more of the lateral surfaces 678 of the inner lateral anvils 674 may be substantially planar or faceted. In such embodiments, the angle between the adjacent lateral surfaces 678 of adjacent inner lateral anvils 674 may be similar or identical to the angle θ described above. In some embodiments, the vertex V of the angle θ may be internally located or may be peripherally located as described herein. Adjacent lateral surfaces 678 of adjacent inner lateral anvils 674 in an unpressed cell assembly 600 may exhibit a gap therebetween. The gap may be similar or identical to the gap G described herein in relation to FIGS. 3A-3E. The shape, angle, and/or gap between the adjacent lateral surfaces 678 of adjacent inner lateral anvils 674 may be shaped, sized, positioned, or otherwise configured to selectively control the flow of CPM 140 radially outward from the longitudinal axis L as a forces F are applied to the cell assembly 600 as described above. In some embodiments, the shape, angle, and/or gap between the adjacent lateral surfaces 678 of adjacent inner lateral anvils 674 may be shaped, sized, positioned, or otherwise configured, along with the shape, dimensions, position, or other configurations of the inner lateral anvils 674 to cause the lateral surfaces 678 of the inner lateral anvils 674 to contact one another. Such a configuration may seal or lock a portion of the CPM 140 between the inner lateral anvils 674 and the canister assembly 110. The plurality of inner lateral anvils 674 may exhibit any of the dimensions, shapes, and/or configurations described above with to any of the lateral anvils disclosed herein.

The outer surface 675 may be proximate to one or more of the outer lateral anvils 654. The outer lateral anvils 654 may be shaped, positioned, dimensioned, and/or otherwise configured to apply or transfer pressure/force against the inner lateral anvils 674 as the forces F are applied to the cell assembly 600. The axial anvils or outer lateral anvils 654 may be similar or identical to any of the axial or lateral anvils described herein. The outer lateral anvils 654 may include an outer surface 655 distal to the inner lateral anvils 674, an inner surface 656 proximate to the outer surface 675 of the inner lateral anvils 674, and one or more lateral surfaces 658 extending between the inner surface 656 and the outer surface 655. One or more of the inner surface 656, the outer surface 655, or the one or more lateral surfaces 658 of the outer lateral anvils 654 may be similar or identical to the inner surface 356, outer surface 355, and lateral surfaces 358 of the lateral anvils 354, or any other lateral anvils disclosed above. In some embodiment, the inner surfaces 656 of the outer lateral anvils 654 may collectively define a portion of a substantially cylindrical or spherical configuration, into which inner lateral anvils 674, the canister assembly 110, the pressure transmitting medium 120, the heating element 130 and one or more additional materials may be at least partially disposed. In some embodiments, the inner surfaces 656 of the outer lateral anvils 654 may collectively define a portion of a substantially cubic, substantially cylindrical, or substantially spherical internal configuration, into which inner lateral anvils 674, the canister assembly 110, the pressure transmitting medium, the heating element 130 and one or more additional materials may be disposed. In some embodiments, the outer surfaces 655 of the outer lateral anvils 654 may collectively define a portion of a substantially cuboid (e.g., cubic), a substantially faceted, substantially cylindrical, or substantially spherical configuration.

In some embodiments, the inner surfaces 656 may be substantially complementary to the outer surfaces 675 of one or more of the inner lateral anvils 674. For example, the inner surface 656 of the outer lateral anvils 654 may be substantially congruent with the outer surface 675 of the inner lateral anvils 674, such as concentric to the lateral surface of the canister assembly 110 (and the longitudinal axis L) as shown. In an embodiment, the inner lateral anvils 674 may have a substantially planar or arcuate inner surface 676 and/or outer surface 675 and the inner surface 656 and/or outer surface 655 of the outer lateral anvils 654 may be correspondingly planar or arcuate. In some embodiments, the inner surface 656 may be substantially non-complementary to the outer surface 675 of one or more of the inner lateral anvils 674. For example, the inner surface 656 of the outer lateral anvils 654 may be substantially planar and the outer surface 675 of the inner lateral anvils 674 may be substantially curved, or vice versa.

In some embodiments, adjacent lateral surfaces 658 of adjacent outer lateral anvils 654 may exhibit an angle θ and/or a gap therebetween. The angle θ and/or the gap may be similar or identical to the angle θ and/or the gap G disclosed above for the inner lateral anvils 674. In some embodiments, the gap between adjacent lateral surfaces 658 may be greater than the gap G disclosed above, such as about 5% to about 100%, about 10% to about 90%, about 25% to about 75%, about 40% to about 60%, or about 50% greater than the gap G.

As shown, the gaps between adjacent inner lateral anvils 674 may be circumferentially offset (e.g., staggered) from the gaps between adjacent outer lateral anvils 654, such that the CPM 140 flowing therethrough has a longer, more tortuous path therethrough. In some embodiments, the gaps between adjacent inner lateral anvils 674 may be substantially aligned with the gaps between adjacent outer lateral anvils 654, such that the CPM 140 flowing therethrough has a shorter, more direct path therethrough. In some embodiments, one or more of the CPM 140, the inner lateral anvils 674, or the outer lateral anvils 654 may be configured (e.g., shaped and positioned) to provide the cell assembly 600 in which the internal anvils 650 have a selected gap and/or selected angle θ prior to application of forces F thereto to provide a selected amount of inward travel of the internal anvils 650 (e.g., such as before they at least partially contact each other). In some embodiments, one or more of the CPM 140, the inner lateral anvils 674, or the outer lateral anvils 654 may be configured (e.g., shaped and positioned) to provide a cell assembly 600 in which the internal anvils 650 have a selected gap and/or selected angle θ prior to application of forces F thereto to provide a selected amount pressure to the canister assembly 110 or rate at which the pressure builds. One or more portions of CPM 140 may be disposed between the canister assembly 110 and the inner lateral anvils 674 and/or between the inner lateral anvils 674 and the outer lateral anvils 654. For example, the amount of CPM 140 between the inner lateral anvils 674 and the pressure transmitting medium tube 120*a*, or the amount of CPM 140 between the inner lateral anvils 674 and the outer lateral anvils 654 may be selected to provide a specific delivered pressure or rate at which the pressure builds at the canister assembly 110. The amount of CPM 140 disposed between one or more of any of the components of the cell assembly 600 may be about 0.1 μm thick or more, such as about 0.1 μm to about 2 cm, about 1 μm to about 1 cm, about 10 μm to about 750 μm, about 100 μm to about 500 μm, about 1 μm to about 500 μm, about 500 μm to about 1 cm, about 1 cm to about 2 cm, less than about 2 cm, or less than 1 cm thick. During application of force from an HPHT press, the CPM 140 between any adjacent surfaces of the cell assembly 600 may compress into a gasket between the adjacent surfaces (e.g., adjacent parallel surfaces of adjacent internal anvils 650, adjacent parallel surfaces of adjacent outer lateral anvils 654 and internal lateral anvils 674, or between any of the internal anvils and the cell assembly canister assembly 110). The gasket may serve to "lock" the components in the cell assembly 600 in place and may aid in transferring pressure/force from the cubic press anvils to the canister assembly 110 in the cell assembly 600.

The outer lateral anvils 654 may exhibit substantially the same thickness as the lateral anvils 254 disclosed above. In some embodiments, the inner lateral anvils 674 may be relatively thinner than the outer lateral anvils 654, such as about 5% or more thinner than the outer lateral anvils 654, about 5% to about 200% thinner than the outer lateral anvils 654, about 10% to about 100% thinner than the outer lateral anvils 654, about 20% to about 80% thinner than the outer lateral anvils 654, about 40% to about 60% thinner than the outer lateral anvils 654, or about 50% thinner than the outer lateral anvils 654. In some embodiments, the inner lateral anvils 674 may be approximately as thick as the outer lateral anvils 654. In some embodiments, the inner lateral anvils 674 may be thicker than the outer lateral anvils 654, such as about 5% or more thicker than the outer lateral anvils 654, about 5% to about 200% thicker than the outer lateral anvils 654, about 10% to about 100% thicker than the outer lateral anvils 654, about 20% to about 80% thicker than the outer lateral anvils 654, about 40% to about 60% thicker than the outer lateral anvils 654, or about 50% thicker than the outer lateral anvils 654.

In some embodiments, the outer lateral anvils 654 may be configured to receive and/or transfer a force exerted by more than one anvil of the cubic press, and the inner lateral anvils may be configured accordingly. Such configurations may include lateral anvils having a plurality of outer surfaces and/or inner surfaces.

Notwithstanding the geometric configurations of the outward facing outer surfaces of the inner lateral anvils and the inner facing inner surfaces of the outer lateral anvils, each outer surface of an inner lateral anvil and inner surface of a corresponding (e.g., adjacent) outer lateral anvil may be configured to engage (e.g., press into or receive force from) the other. Notwithstanding the geometric configurations of any of the outer surfaces of the lateral anvils or outer lateral anvils adjacent to HPHT press anvils disclosed herein, the outer surfaces of the lateral anvils or outer lateral anvils adjacent to HPHT press anvils may be sized, shaped, and configured to engage the HPHT press anvils.

Each layer of concentrically layered internal anvils of FIGS. 6 and 7 may provide a progressive increase in pressure toward the center of the cell assembly (e.g., the canister assembly 110). For example, the outer lateral anvils 654 may receive a pressure from the cubic press anvils (not shown) and intensify the pressure inward toward the inner lateral anvils and the longitudinal axis L. The pressure received at the inner lateral anvils 674 may be greater than the pressure received at the outer lateral anvils 654 from the cubic press anvils. The pressure received at the inner lateral anvils 674 may be intensified by the inner lateral anvils 674 and transferred inward toward the canister assembly 110

(e.g., toward the longitudinal axis L). Such a configuration may provide a progressive intensification (e.g., stepwise between layers or continuously as a function of inward travel from the outer surface of the cell assembly toward the longitudinal axis L) of the force delivered to the outer surface 656 of the outer lateral anvils 654 by the cubic press anvils inwardly toward the longitudinal axis L.

The internal anvils, canister assemblies, heating elements, and pressure transmitting mediums in FIGS. 6 and 7 may be positioned in the pressure transmitting medium 140 by any of the techniques disclosed herein, such as, but not limited to placement into one or more preformed cavities as described with respect to FIGS. 5A and 5B.

FIG. 7 is a top cross-sectional view of a cell assembly 700, according an embodiment. The cell assembly 700 includes a plurality of internal anvils 750 positioned about a longitudinal axis L. The plurality of internal anvils 750 includes a plurality of outer lateral anvils 754, a plurality of inner lateral anvils 774, and a plurality (e.g., two, four, or more than four) of axial anvils (not shown). The cell assembly 700 includes a canister assembly 110, one or more portions of pressure transmitting medium 120 (e.g., pressure transmitting medium tube 120*a* and/or pressure transmitting medium cap, disk, or plug 120*b*) disposed about the canister assembly 110, and heating element 130 disposed about at least an inner portion of pressure transmitting medium 120, each as disclosed herein above. The plurality of inner lateral anvils 774 may be disposed proximate to and about the lateral surface of the canister assembly 110, one or more portions of pressure transmitting medium tube 120*a*, and heating element 130 (e.g., heater tube 132); and/or between any of the same and the plurality of outer lateral anvils 754. For example, the inner lateral anvils 774 may be substantially circumferentially and equidistantly spaced about the lateral surface of the canister assembly 110. All of the foregoing may be at least partially internal to (e.g., embedded within) the CPM 140. In some embodiments, the outer lateral anvils 754 and/or the axial anvils (not shown) may at least partially protrude from the CPM 140 (or be substantially coplanar with an outer surface of the CPM 140), such as having an inner surface internal to the CPM and an outer surface protruding therefrom.

The inner lateral anvils 774 include an inner surface 776 proximate to the canister assembly 110 and at least one outer surface 775 separated from the inner surface 776 and distal to the canister assembly 110. In some embodiments, the inner surface 776 of the inner lateral anvils 774 may be substantially planar or curved (e.g., concave or convex). In some embodiments, the inner surface 776 of the inner lateral anvils may have a curvature substantially complementary (e.g., parallel or concentric) to the curvature of the lateral surface of the canister assembly 110 or one or more components therebetween (e.g., the pressure transmitting medium tube 120*a*), such as a substantially concentric configuration. In some embodiments, the at least one outer surface 775 of the inner lateral anvils 774 may be shaped different than the inner surface 776. For example, the at least one outer surface 775 may include a plurality of outer surfaces 775, at least some of which are configured to substantially correspond to (e.g., congruent with, extend parallel to, etc.) an inner surface 756 of one the outer lateral anvils 754. At least some of the plurality of outer surfaces 775 may be non-concentric to the lateral surface of the canister assembly 110. Although in the illustrated embodiment, the adjacent outer surfaces 775 of two adjacent inner lateral anvils 774 are substantially planar, in some embodiments, the adjacent outer surfaces 775 of two adjacent inner lateral anvils 774 may collectively define a surface (notwithstanding the gap G, therebetween) substantially concentric to the lateral surface of the canister assembly 110.

In some embodiments, each of the at least one outer surfaces 775 of the inner lateral anvils 774 may have a substantially planar configuration while the inner surface 776 has an arcuate (e.g., concave) configuration, or vice versa. The inner surface 776 may exhibit any of the configurations for an inner surface described above with respect to any of the anvils herein, such as inner surface 256 of internal anvils 250.

As shown, the inner lateral anvils 774 may have one or more lateral surfaces 778. In some embodiments, one or more of the lateral surfaces 778 of the inner lateral anvils 774 may be substantially planar, arcuate, polygonal (e.g., faceted), or combinations thereof. In some embodiments, an angle θ between the adjacent lateral surfaces 778 of adjacent inner lateral anvils 774 may be similar or identical to the angle θ described above in relation to FIGS. 3A-3C. The vertex V of the angle θ may be internally located (as shown in FIG. 7) or may be peripherally located as described herein. Adjacent lateral surfaces 778 of adjacent inner lateral anvils 774 in an unpressed cell assembly 700 may exhibit a gap $G_i$ therebetween. The gap $G_i$ between adjacent lateral surfaces of adjacent lateral anvils 774 (and/or a lateral anvils 774 and axial anvil (not shown)) may be similar or identical to the gap G described herein in relation to FIGS. 3A-3C. The shape, angle θ, and/or gap $G_i$ between the adjacent lateral surfaces 778 of adjacent inner lateral anvils 774 may be shaped, sized, positioned, or otherwise configured to selectively control the flow of CPM 140 outward from the longitudinal axis L as a forces F are applied to the cell assembly 700 as described above with respect to the cell assembly 300. In some embodiments, the shape, angle θ, and/or gap $G_i$ between the adjacent lateral surfaces 778 of adjacent inner lateral anvils 774 may be shaped, sized, positioned, or otherwise configured; along with the shape, dimensions, position, or other configurations of the inner lateral anvils 774 to cause the lateral surfaces 778 of the inner lateral anvils 774 to contact one another. Such a configuration may seal or lock a portion of the CPM 140 between the inner lateral anvils 774 and canister assembly 110, such as to form a gasket of CPM 140 between adjacent surfaces of the cell assembly 700, as described herein. The plurality of inner lateral anvils 774 may exhibit any of the dimensions, shapes, and/or configurations described above with respect to any of the lateral anvils disclosed herein, without limitation.

The outer surface 775 may be proximate to one or more outer lateral anvils 754. The one or more outer lateral anvils 754 may be shaped, positioned, dimensioned, and/or otherwise configured to apply or transfer force or pressure against the inner lateral anvils 774 as the forces F are applied to the cell assembly 700 (e.g., from at least six different directions). The axial anvils (not shown) may be similar or identical to any of the axial anvils described herein. The outer lateral anvils 754 may include at least one outer surface 755 distal to the inner lateral anvils 774, an inner surface 756 proximate to the inner lateral anvils and substantially opposite the outer surface 755. For example, the outer lateral anvils 754 may be substantially triangular with a substantially planar inner surface 756 and two substantially planar outer surfaces 755.

As shown, each of the outer lateral anvils 754 may include two outer surfaces 755 intersecting at about a 90 degree angle or other suitable angle and each configured to receive force F from adjacent anvils 780*a*-780*d* of a cubic press (e.g., HPHT press). For example, the cubic press may include four anvils 780*a*-780*d* disposed about the lateral surface of the cell assembly 700 and two anvils (not shown) configured to press vertically inward from the top and bottom of the cell assembly 700. Each of the four anvils 780*a*-780*d* may press inwardly on the cell assembly 700 from four different directions (e.g., each at about 90 degrees with respect to the next press head). Each of the outer lateral anvils 754 may be biased inward by a force F from at least two of the anvils 780*a*-780*d*. For example, the anvils 780*b* and 780*c* may each press inward on the respective outer surfaces 755 of the same outer lateral anvil 754, biasing the outer lateral anvil 754 inward toward the inner lateral anvils 774 and canister assembly 110.

In some embodiments, one or more of the inner surface 756 and/or outer surfaces 755 may be substantially planar or curved (e.g., concave or convex). In some embodiments, the outer lateral anvils 754 may include one or more lateral surfaces (not shown) extending between the inner surface 756 and the outer surfaces 755. The plurality of outer lateral anvils 754 may exhibit any of the dimensions, shapes, and/or configurations described above with respect to any of the lateral anvils disclosed herein, without limitation.

In some embodiments, the inner surface 756 may be substantially complementary to corresponding outer surfaces 775 of one or more of the inner lateral anvils 774. For example, the inner surface 756 of the outer lateral anvils 754 may be substantially congruent with an outer surface 775 of adjacent inner lateral anvils 774, such as each being substantially concentric to the lateral surface of the canister assembly 110 (and the longitudinal axis L) as shown.

In an embodiment (not shown), the inner lateral anvils 774 may have a substantially planar inner surface 776. In an embodiment, the inner lateral anvils 774 may exhibit a single substantially planar outer surface 775. As shown in FIG. 7, the inner lateral anvils 774 may have a substantially faceted outer surface 775. In some embodiments, the inner surface 756 and/or outer surface 755 of the outer lateral anvils 754 may be substantially planar (e.g., a single plane or faceted). For example, the outer surfaces 775 of the inner lateral anvils 774 may collectively define a portion of a substantially cubic shape, and the inner surfaces 756 of the outer lateral anvils 754 may collectively define at least a portion of an inner cubic shape (cubic cavity) substantially complementary/congruent to the collective outer surfaces 775 of the inner lateral anvils 774. In some embodiments, the outer surfaces 755 of the outer lateral anvils may collectively define a substantially cuboid configuration or any other configuration disclosed herein. In some embodiments, the inner surface 756 may be substantially non-complementary to the outer surface 775 of one or more of the inner lateral anvils 774. For example, the inner surface 756 of the outer lateral anvils 754 may be substantially planar and the outer surface 775 of the inner lateral anvils 774 may be substantially curved, or vice versa.

In some embodiments, adjacent outer lateral anvils 754 may exhibit a gap $G_o$ therebetween. In some embodiments, the outer lateral anvils 754 may include lateral surfaces (not shown). In such embodiments, the lateral surfaces of adjacent outer lateral anvils 754 may exhibit angle (not shown) therebetween. The lateral surfaces may define and angle having an internally located vertex or a peripherally located vertex as described herein. The angle and/or the gap $G_o$ between adjacent outer lateral anvils 754 may be similar or identical to the angle θ and/or the gap G disclosed above. In some embodiments, the gap $G_o$ between adjacent lateral surfaces of adjacent outer lateral anvils 754 may be greater than the gap G disclosed above, such as about 5% to about 100%, about 10% to about 90%, about 25% to about 75%, about 40% to about 60%, or about 50% greater than the gap G.

As shown, the gaps $G_i$ between adjacent inner lateral anvils 774 may be offset (e.g., staggered) from the gaps $G_o$ between adjacent outer lateral anvils 754, such that the CPM 140 flowing therethrough has a longer, more tortuous path therethrough. In some embodiments, the gaps $G_i$ between adjacent inner lateral anvils 774 may be substantially aligned with the gaps $G_o$ between adjacent outer lateral anvils 754, such that the CPM 140 flowing therethrough has a shorter, more direct path therethrough. In some embodiments, one or more of the CPM 140, inner lateral anvils 774, and/or outer lateral anvils 754 may be configured (e.g., shaped and positioned) to provide the cell assembly 700 in which at least some of the internal anvils 750 have a selected gap and/or selected angle θ prior to application of forces F thereto to provide a selected amount of inward travel of the at least some internal anvils 750 (e.g., the inner lateral anvils 774 and/or outer lateral anvils 754) (e.g., before they at least partially contact each other or lock the CPM 140 therebetween). In some embodiments, one or more of the CPM 140, the inner lateral anvils 774, or the outer lateral anvils 754 may be configured (e.g., shaped and positioned) to provide the cell assembly 700 in which the internal anvils 750 (e.g., the inner lateral anvils 774 and/or outer lateral anvils 754) have a selected gap $G_i$ and/or $G_o$ and/or selected angle θ therebetween prior to application of forces F thereto, which may provide a selected amount pressure to the canister assembly 110 or rate at which the pressure builds. For example, the amount of CPM 140 between the inner lateral anvils 774 and the pressure transmitting medium tube 120*a*, and/or the amount of CPM 140 between the inner lateral anvils 774 and the outer lateral anvils 754 may be selected to provide a specific delivered pressure or rate at which the pressure builds at the canister assembly 110. The amount of CPM 140 disposed between one or more of any of the portions of the cell assembly 700 may be about 0.1 μm thick or more, such as about 0.1 μm to about 2 cm, about 1 μm to about 1 cm, about 10 μm to about 750 μm, about 100 μm to about 500 μm, about 1 μm to about 500 μm, about 500 μm to about 1 cm, about 1 cm to about 2 cm, less than about 2 cm, or less than 1 cm thick.

The outer lateral anvils 754 may exhibit substantially the same thickness as the lateral anvils 254 disclosed above. In some embodiments, the inner lateral anvils 774 may be thinner than the outer lateral anvils 754, such as about 5% or more thinner than the outer lateral anvils 754, about 5% to about 200% thinner than the outer lateral anvils 754, about 10% to about 100% thinner than the outer lateral anvils 754, about 20% to about 80% thinner than the outer lateral anvils 754, about 40% to about 60% thinner than the outer lateral anvils 754, or about 50% thinner than the outer lateral anvils 754. In some embodiments, the inner lateral anvils 774 may be substantially as thick as the outer lateral anvils 754. In some embodiments, the inner lateral anvils 774 may be thicker than the outer lateral anvils 754, such as about 5% or more thicker than the outer lateral anvils 754, about 5% to about 200% thicker than the outer lateral anvils 754, about 10% to about 100% thicker than the outer lateral anvils 754, about 20% to about 80% thicker than the outer lateral anvils 754, about 40% to about 60% thicker than the outer lateral anvils 754, or about 50% thicker than the outer lateral anvils 754.

In any of the embodiments disclosed herein, a ceramic insulator (e.g., electrical insulator) or anvil material may be positioned between the CPM and the canister assembly 110, such as between the CPM and the outermost layer of pressure transmitting medium 120 or heating element 130 or 130'. The ceramic insulator or anvil material may include a ceramic, a cermet, or any anvil material disclosed herein. Suitable material may include cobalt-cemented tungsten carbide, iron-cemented tungsten carbide, or any other cemented carbide; zirconia; or any other substantially non-conducting ceramic. In such embodiments, the bulk modulus of the ceramic insulator or anvil material may be effective to maintain and/or increase the overall pressure in the cell assembly due to limiting compression and/or even expansion of the ceramic insulator or anvil material under HPHT conditions. Such ceramic insulator or anvil materials may exhibit a bulk modulus above about 150 GPa, such as above about 200 GPa, above about 300 GPa, or above about 400 GPa. Any of the anvils disclosed herein may exhibit a bulk modulus of about 150 GPa or more, such as about 200 GPa or more, about 250 GPa or more, about 300 GPa or more, about 350 GPa or more, about 400 GPa or more, or about 150 GPa to about 400 GPa.

In some embodiments, any of the internal anvils may be split. That is, one or more of the internal anvils may include two or more pieces disposed adjacent to one another to form one of the internal anvils disclosed herein. For example, any of the lateral anvils herein may be bisected in half, such as by an axial cut (or a circumferential cut) extending radially outward from the longitudinal axis L. Such configurations may allow for efficient construction of cell assemblies and/or positioning of internal anvils in a CPM.

The embodiments herein may extend the number of cycles for anvils of a cubic press. The internal anvils disclosed herein may distribute the pressure applied from the cubic press anvils more efficiently/evenly throughout a cell assembly, which may in turn reduce tensile forces on the cubic press anvils, reducing wear and/or breakage.

Figure 8:
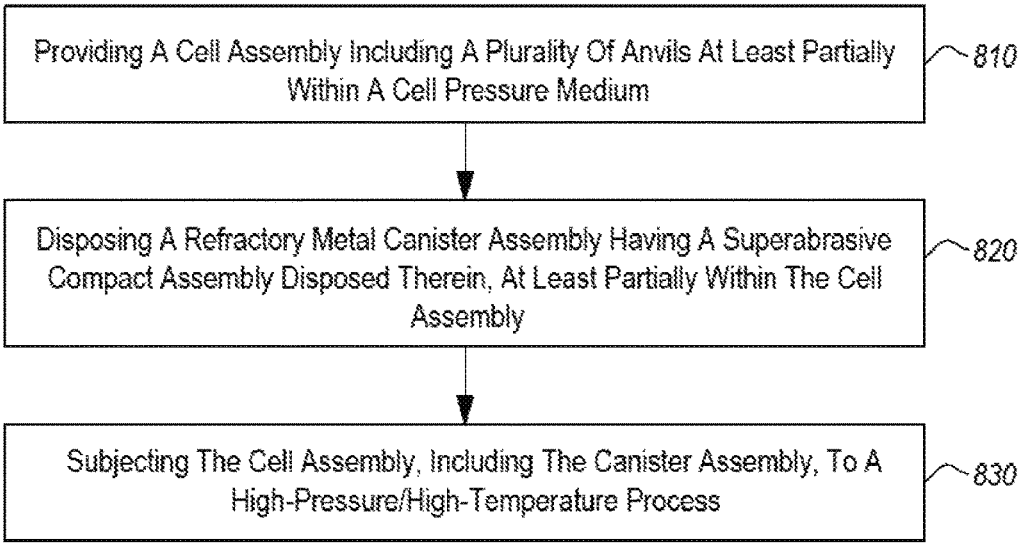
FIG. 8 is a flow chart of a method of processing a superabrasive compact assembly in a cubic press, according to an embodiment.

FIG. 8 is a flow chart of an embodiment of a method 800 of processing a superabrasive compact assembly in a cubic press (e.g., making a superabrasive compact). The method includes an act 810 providing a cell assembly; an act 820 disposing a refractory metal canister assembly having a superabrasive compact assembly disposed therein, at least partially within the cell assembly; and act 830 subjecting the cell assembly including the refractory metal canister assembly to a high-pressure/high-temperature process.

The act 810 of providing a cell assembly may include forming and/or providing one or more of a cell assembly or a refractory metal canister assembly. The refractory metal canister assembly may include any canister assembly or portion thereof disclosed herein. For example, the canister assembly may include a refractory metal canister (e.g., defining a recess terminating in an open end) and a superabrasive compact assembly at least partially disposed therein. The superabrasive compact assembly may include any of the superabrasive compact precursor assemblies described herein, such as a PDC precursor assembly having a substrate and a volume of diamond powder or a pre-sintered PCD body. In an embodiment, the canister assembly may include a refractory metal canister and a refractory metal cap disposed over the open end of the refractory metal canister. Forming a canister assembly may include sealing the canister assembly, such as sealing the cap over the canister as disclosed above. Sealing the canister assembly may substantially seal the contents of the canister assembly (e.g., the precursor assembly) from the external environment.

The cell assembly may include any of the cell assemblies or portions thereof disclosed herein. For example, the cell assembly may include one or more portions of pressure transmitting medium that define a space into which the canister assembly may be at least partially positioned. At least one layer of the pressure transmitting medium may at least partially surround the canister assembly. The pressure transmitting medium may be configured and positioned similarly or identical to any pressure transmitting medium disclosed herein. The cell assembly may include a heating element, configured and positioned similarly or identical to any heating element disclosed herein. The cell assembly may include a CPM at least partially surrounding the pressure transmitting medium and canister assembly. The CPM may be positioned and configured similarly or identical to any CPM disclosed herein. The cell assembly includes a plurality of anvils, at least some which are positioned at least partially within the CPM. The internal anvils and/or position thereof may be similar or identical any internal anvils disclosed herein (e.g., 6 internal anvils, 10 internal anvils, inner and outer lateral anvils, round, polygonal, colliding, etc.).

The act 810 of providing the cell assembly may include the act of forming the cell assembly. For example, the method 800 may include an act of making a cell assembly including a green state CPM and positioning one or more internal anvils and/or the canister assembly therein. Making the green state CPM may include pressing, using an adhesive, punching, heating, machining, lasing, or combinations thereof. Making the green state CPM may include forming a coherent mass of CPM by one or more of pressing, heating, using an adhesive. Making the green state CPM may include processing the coherent mass to form one or more cavities therein, such as by machining, lasing, grinding, or punching. For example one or more punches having a positive form of the one or more desired cavities may be pressed into the coherent mass of CPM. In some embodiments, more than one green state CPM may be used to form a single cell assembly. In such embodiments, a single coherent mass of CPM may be cut and then processed to form cavities therein, or separate coherent masses of CPM may be processed to form cavities therein. In an embodiment, making the canister assembly may include assembling the canister assembly using any of the components thereof described herein.

In an embodiment, providing a cell assembly may include forming or providing one or more of the canister assembly, one or more portions of pressure transmitting medium, heating element, and one or more internal anvils in at least a portion the (powdered or coherent) CPM.

The method 800 may include the act 820 of disposing a refractory metal canister assembly having a superabrasive compact assembly disposed therein, at least partially within the cell assembly. The act 820 of disposing a refractory metal canister assembly having a superabrasive compact assembly disposed therein, at least partially within the cell assembly may include positioning at least some of the internal anvils and CPM around the canister assembly, pressure transmitting medium, and heating element. For example, disposing the canister assembly in the cell assembly may include placing the canister assembly on a base layer of CPM and an axial anvil therein and then assembling the rest of the cell assembly there around. The assembled cell assembly may then be pressed, bound, glued, or otherwise temporarily bonded to form a unitary part for HPHT processing.

The act 820 of disposing a refractory metal canister assembly at least partially within a cell assembly may include an act of positioning the canister assembly in the central cavity of a CPM. In an embodiment, disposing a refractory metal canister assembly in a cell assembly may include positioning powdered CPM around one or more of the canister assembly, at least one pressure transmitting layer, heating element, or one or more internal anvils. Optionally, such an assembly may be cold pressed to form a green state CPM having the materials described above at least partially internal thereto. In some embodiments, the act 820 of disposing a refractory metal canister assembly in a cell assembly may include the act of positioning one or more internal anvils in a CPM (e.g., pressing into a powdered CPM as described above, or inserting into a green state CPM as described herein). In some embodiments, a canister assembly may include two opposing canister assemblies (e.g., having their lower (base) surfaces adjacent to one another) such that one cell assembly can be used to make two superabrasive compacts. In such embodiments, the dimensions of the pressure transmitting medium, the heating element, the CPM, and the plurality of internal anvils may be correspondingly adjusted to accommodate the dimensions of the opposing canister assemblies as compared to one single canister assembly. In some embodiments, disposing a canister assembly in a cell assembly may include disposing additional CPM material (e.g., powder) between any portions of the cell assembly described herein or between any portions of the cell assembly and the canister assembly described herein. Disposing additional CPM material in the cell assembly may reduce or eliminate any open voids between any portions of the cell assembly or between any portions of the cell assembly and the canister assembly. Such embodiments may reduce uneven pressure in the cell assembly during HPHT processing.

The method may include an act of providing at least one anvil positioned at least partially within the cell assembly may include forming a cell assembly or a portion thereof, such as any disclosed herein. Providing at least one anvil positioned at least partially within the cell assembly may include forming one or more cavities in a CPM, such as forming a green state CPM and forming (e.g., molding, milling, or otherwise making) one or more cavities (e.g., central cavity and/or anvil cavities) therein. In an embodiment, providing at least one anvil positioned at least partially within the cell assembly may include positioning one or more internal anvils at least partially within the one or more cavities. In an embodiment, providing at least one anvil positioned at least partially within the cell assembly may include forming a central cavity and positioning one or more of the canister assembly, heating element, or pressure transmitting medium therein. In an embodiment, providing at least one anvil positioned at least partially within the cell assembly may include disposing a CPM powder in a confined space (e.g., mold or form) disposing one or more of the plurality of internal anvils, canister assembly, heating element, or pressure transmitting medium therein, and pouring additional amounts of the CPM powder into the configure space to surround and hold the plurality of internal anvils, canister assembly, heating element, or pressure transmitting medium therein. Upon filling the confined space with the CPM powder, the cell assembly may be pressed into a green state part, may be left in the form, may be at least partially adhered together, and/or may be placed in packaging to maintain the as-formed or desired configuration.

In an embodiment, the act 830 of subjecting the cell assembly including the canister assembly to an HPHT process includes applying pressure to the cell assembly at an upper surface and a lower (base) surface (e.g., longitudinally). For example, applying pressure to the cell assembly may include contacting the cell assembly with one or more HPHT press anvils. In an embodiment, applying pressure to the cell assembly additionally includes applying pressure to the lateral surface(s) of the cell assembly (e.g., radially inward). For example, the lateral surface(s) may be pressed inward from at least four lateral directions. In an embodiment, at least one surface of an internal anvil may be contacted by an HPHT press anvil. In an embodiment, CPM adjacent to at least one surface of an internal anvil may be contacted by an HPHT press anvil effective to transfer at least some of the force delivered by the HPHT press anvil to the internal anvil. In such embodiments, a cubic press (e.g., HPHT press) may be used to apply the pressure to the cell assembly. Subjecting the cell assembly including the canister assembly therein to an HPHT process includes subjecting the cell assembly to a pressure and temperature effective to sinter the precursor assembly materials therein. Subjecting the cell assembly including the canister assembly therein to an HPHT process may include subjecting the cell assembly including the canister assembly therein diamond-stable HPHT conditions including a pressure of about 4 GPa or more, such as about 4 GPa to about 15 GPa, about 5 GPa to about 12 GPa, about 6 GPa to about 10 GPa, about 4 GPa to about 7 GPa, about 7 GPa to about 12 GPa, or about 9 GPa to about 15 GPa; and a temperature of about 1200° C. to about 2200° C., about 1400° C. to about 2000° C., about 1500° C. to about 1800° C., about 1400° C. to about 1600° C., about 1600° C. to about 1800° C., or about 1800° C. to about 2200° C.

In an embodiment, subjecting the cell assembly including the canister assembly therein to an HPHT process includes causing at least some of the CPM to extrude out of the cell assembly through one or more gaps between adjacent anvils. As described above, the one or more gaps being may be formed by radially extending (e.g., lateral) surfaces between adjacent anvils. The radially extending lateral surfaces define or form non-parallel radially extending positive angles therebetween.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A cell assembly for use in a high-pressure/high-temperature cubic press, the cell assembly comprising:

a refractory metal canister assembly having a superabrasive compact precursor assembly disposed at least partially therein;

a pressure transmitting medium at least partially surrounding the refractory metal canister assembly;

a cell pressure medium at least partially surrounding the pressure transmitting medium and the refractory metal canister assembly;

a heating element positioned adjacent to the refractory metal canister assembly; and a plurality of anvils, at least some of the plurality of anvils positioned at least partially within the cell pressure medium.

2. The cell assembly of claim 1, further comprising a ceramic insulator disposed between the heating element and the plurality of anvils.

3. The cell assembly of claim 1, wherein:

the refractory metal canister assembly includes an upper surface, a lower surface, and at least one lateral surface extending therebetween; and wherein the at least some of the plurality of anvils includes a first anvil positioned adjacent to the upper surface and a second anvil positioned adjacent to the lower surface.

4. The cell assembly of claim 3, wherein the at least some of the plurality of anvils includes a plurality of lateral anvils positioned and configured to apply pressure at least partially toward at least a portion of the at least one lateral surface of the refractory metal canister assembly.

5. The cell assembly of claim 4, wherein:

the plurality of lateral anvils includes at least four lateral anvils, each of the at least four lateral anvils having an inner surface, an outer surface, and at least one lateral surface therebetween; and one or more of the at least one lateral surfaces of the at least four lateral anvils extends from the inner surface at an angle of greater than 0 degrees to about 60 degrees with respect to the at least one lateral surface of an adjacent one of the at least four lateral anvils.

6. The cell assembly of claim 4, wherein each of the plurality of lateral anvils includes a concave inner surface having a configuration that is substantially complementary to the at least one lateral surface of the refractory metal canister assembly.

7. The cell assembly of claim 4, wherein:

the cell pressure medium defines a central cavity and a plurality of anvil cavities;

the plurality of anvil cavities are positioned adjacent to the central cavity in the cell pressure medium; and each of the plurality of lateral anvils is positioned at least partially within in a corresponding one of the plurality of anvil cavities.

8. The cell assembly of claim 4, wherein:

each of the plurality of anvils includes an inner surface, an outer surface, and at least one lateral surface therebetween; and the inner surface of one or more of the plurality of anvils exhibits a smaller surface area than the outer surface thereof.

9. The cell assembly of claim 8, wherein:

the inner surface of each of the plurality of lateral anvils exhibits a concave configuration that is substantially complementary to the at least one lateral surface of the refractory metal canister assembly; and the outer surface of each of the plurality of lateral anvils is substantially planar.

10. The cell assembly of claim 9, wherein the at least one lateral surface of the refractory metal canister assembly is substantially cylindrical and the outer surfaces collectively define at least part of a substantially cubic outer shape.

11. The cell assembly of claim 4, wherein at least one of the plurality of anvils includes one or more of a carbide, sintered diamond, ceramic, a refractory metal, titanium, or steel.

12. The cell assembly of claim 4, wherein the plurality of lateral anvils includes:

a plurality of inner lateral anvils positioned adjacent to the refractory metal canister assembly; and a plurality of outer lateral anvils positioned adjacent to the plurality of inner lateral anvils.

13. The cell assembly of claim 1, wherein the cell pressure medium at least partially surrounds the pressure transmitting medium and the refractory metal canister assembly, and wherein the cell pressure medium includes a cavity that at least partially receives the pressure transmitting medium and the refractory metal canister assembly therein.

14. The cell assembly of claim 13, wherein the cell pressure medium includes a plurality of anvil cavities each of which at least partially receives a corresponding one of the plurality of anvils therein.

15. The cell assembly of claim 1, wherein:

the refractory metal canister assembly includes an upper surface, a lower surface, and at least one lateral surface extending therebetween;

the plurality of anvils includes:

a first anvil disposed adjacent to the upper surface;

a second anvil disposed adjacent to the lower surface;

a plurality of lateral anvils disposed circumferentially around at least a portion of the at least one lateral surface of the refractory metal canister assembly; and wherein each of the plurality of lateral anvils includes an inner surface adjacent to the refractory metal canister assembly, an outer surface generally opposite the inner surface, and at least one lateral surface therebetween, the inner surface having a smaller surface area than the outer surface and exhibiting a geometry that is substantially complementary with at least a portion of the at least one lateral surface of the refractory metal canister assembly.

16. A method of high-pressure/high-temperature processing a superabrasive compact assembly, the method comprising:

providing a cell assembly;

disposing a refractory metal canister assembly including the superabrasive compact assembly disposed therein, at least partially within the cell assembly;

wherein the cell assembly includes:

a pressure transmitting medium that at least partially surrounding the refractory metal canister assembly;

a cell pressure medium at least partially surrounding the pressure transmitting medium and the refractory metal canister assembly;

a heating element positioned adjacent to the refractory metal canister assembly; and a plurality of anvils, at least some of the plurality of anvils being positioned at least partially within the cell pressure medium; and subjecting the cell assembly, including the refractory metal canister assembly, to a high-pressure/high-temperature process.

17. The method of claim 16, wherein subjecting the cell assembly including the refractory metal canister assembly to a high-pressure/high-temperature process includes causing at least some of the cell pressure medium to extrude out of the cell assembly through one or more gaps between adjacent anvils.

18. The method of claim 16, wherein the superabrasive compact assembly includes a cemented carbide substrate and a plurality of superhard particles.

19. The method of claim 18, wherein the cemented carbide substrate includes cobalt-cemented tungsten carbide and the plurality of superhard particles includes diamond particles.

20. The method of claim 18, wherein:

the refractory metal canister assembly includes an upper surface, a lower surface, and at least one lateral surface extending therebetween; and the plurality of anvils includes:

a first anvil disposed adjacent to the upper surface;

a second anvil disposed adjacent to the lower surface;

a plurality of lateral anvils disposed circumferentially around at least a portion of the at least one lateral surface of the refractory metal canister assembly; and wherein each of the plurality of lateral anvils includes an inner surface adjacent to the refractory metal canister assembly, an outer surface generally opposite the inner surface, and at least one lateral surface therebetween, the inner surface having a smaller surface area than the outer surface and exhibiting a geometry that is substantially complementary with at least a portion of the at least one lateral surface of the refractory metal canister assembly.

* * * * *